US012234583B2

(12) United States Patent
Ramaratnam et al.

(10) Patent No.: US 12,234,583 B2
(45) Date of Patent: Feb. 25, 2025

(54) APERTURED HYDRO-PATTERNED NONWOVEN AND METHOD OF MAKING THE SAME

(71) Applicants: PFNONWOVENS LLC, Hazleton, PA (US); PFNONWOVENS HOLDING S.R.O, Prague (CZ)

(72) Inventors: Karthik Ramaratnam, Anderson, SC (US); Peter Zajaczkowski, Greenville, SC (US); John C. Parsons, Annville, PA (US); Michael Heinz Kauschke, PRIEN am Chiemsee (DE); Antonius Lambertus Johannes De Beer, Loveland, OH (US)

(73) Assignees: PFNONWOVENS LLC, Hazleton, PA (US); PFNONWOVENS HOLDING S.R.O, Prague (CZ)

( * ) Notice: Subject to any disclaimer, the term of this patent is extended or adjusted under 35 U.S.C. 154(b) by 235 days.

(21) Appl. No.: 17/735,687

(22) Filed: May 3, 2022

(65) Prior Publication Data

US 2022/0356617 A1 Nov. 10, 2022

Related U.S. Application Data

(60) Provisional application No. 63/183,190, filed on May 3, 2021.

(51) Int. Cl.
*D04H 1/46* (2012.01)
*D04H 1/724* (2012.01)

(52) U.S. Cl.
CPC ..... *D04H 1/465* (2013.01); *D04H 1/724* (2013.01); *D10B 2321/022* (2013.01)

(58) Field of Classification Search
CPC ... D04H 1/465; D04H 1/724; D10B 2321/022
USPC ..... 156/252
See application file for complete search history.

(56) References Cited

U.S. PATENT DOCUMENTS 7,323,072 B2 * 1/2008 Engelhart ..... D04H 1/542 156/73.2

* cited by examiner

*Primary Examiner* — James D Sells
(74) *Attorney, Agent, or Firm* — Amster, Rothstein & Ebenstein LLP

(57) ABSTRACT

A method of forming an apertured hydro-patterned nonwoven web including the steps of forming a nonwoven batt comprising continuous spunmelt fibers, calender bonding the nonwoven batt to form a fully bonded precursor nonwoven web with a regular bond pattern that defines individual bond impressions and unbonded areas between the individual bond impressions, the regular bond pattern having a percentage bond area of 10% to 25%, and hydraulically imparting the fully bonded precursor nonwoven web with a plurality of apertures, the step of hydraulically imparting comprising hydraulically treating the fully bonded precursor nonwoven web by a plurality of steps of water injection as the fully bonded nonwoven web passes over a plurality of pins.

81 Claims, 24 Drawing Sheets

PATTERN 1

PATTERN 2

PATTERN 3

PATTERN 4

APERTURED HYDRO-PATTERNED NONWOVEN AND METHOD OF MAKING THE SAME

RELATED APPLICATION

This application claims priority to and the benefit of U.S. Provisional Application No. 63/183,190, filed May 3, 2021 and entitled APERTURED HYDRO-PATTERNED NONWOVEN AND METHOD OF MAKING THE SAME, the contents of which are incorporated herein by reference in their entirety.

FIELD OF THE INVENTION

The present invention relates to apertured nonwovens and an improved method of manufacturing apertured nonwovens in which the nonwoven is imparted with a bond pattern before being subjected to hydraulic treatment to form apertures in the nonwoven.

BACKGROUND OF THE INVENTION

Spunmelt nonwovens (e.g., spunbond nonwovens, meltblown nonwovens or combinations thereof) are formed of thermoplastic continuous fibers such as polypropylene (PP), polyethylene terephthalate (PET) etc., bi-component or multi-component fibers, as well as mixtures of such spunmelt fibers with rayon, cotton and cellulosic pulp fibers, etc. Conventionally, spunmelt nonwovens are thermally, ultrasonically, chemically (e.g., by latex), or resin bonded, etc., to produce bonds which are substantially non-frangible and retain their identity through post-bonding processing and conversion. Thermal and ultrasonic bonding produce permanent fusion bonds, while chemical bonding may or may not produce permanent bonding.

It is known to apply hydraulic treatment to improve fabric properties, such as softness or bulkiness. One known hydraulic treatment process, called hydroengorgement, is described in, for example, U.S. Pat. No. 7,858,544. It is also known to form apertures in nonwoven webs by many methods using different technical processes. Such processes include application of heat (e.g., overbonding, hot needles or hot pins, etc.) or hydraulic treatment using different types of screens (e.g., by pushing the fabric into openings or around pins/protrusions) as described in, for example, U.S. Pat. Nos. 7,455,800; 7,091,140; 6,321,425; 6,903,034; and 4,886,632. Aperture patterns formed by hydraulic treatment are in general formed in lower bonded fabric by a plurality of steps of water injection, each over a corresponding screen having a predetermined pattern of apertures, as described in, for example, U.S. Pat. No. 10,737,459. For spunmelt fabrics, calender bonding is used to provide most of the fabric mechanical properties, with subsequent hydraulic treatment used to possibly enhance softness and provide apertures.

However, the need for the lower level of bonding is limiting on final fabric stability and tensile strength. Past efforts to use hydraulic treatment aperturing techniques on higher bonded fabrics have not produced satisfactory results in terms of aperture clarity, and thus using such techniques to achieve desirable levels of fabric qualities such as softness and strength has been difficult.

Accordingly, a method of producing an apertured nonwoven fabric from a fully bonded precursor web is needed that results in a product that exhibits an improved combination of properties such as aperture clarity, softness, abrasion resistance or tensile strength.

SUMMARY OF THE INVENTION

A method of forming an apertured hydro-patterned nonwoven web according to an exemplary embodiment of the present invention comprises: forming a nonwoven batt comprising continuous spunmelt fibers; calender bonding the nonwoven batt to form a fully bonded precursor nonwoven web with a regular bond pattern that defines individual bond impressions and unbonded areas between the individual bond impressions, the regular bond pattern having a percentage bond area of 10% to 25%; and hydraulically imparting the fully bonded precursor nonwoven web with a plurality of apertures, the step of hydraulically imparting comprising hydraulically treating the fully bonded precursor nonwoven web by a plurality of steps of water injection as the fully bonded nonwoven web passes over a plurality of pins.

A method of forming an apertured hydro-patterned nonwoven web according to an exemplary embodiment of the present invention comprises: forming a nonwoven batt comprising continuous spunmelt fibers; calender bonding the nonwoven batt to form a fully bonded precursor nonwoven web with a regular bond pattern that defines individual bond impressions and unbonded areas between the individual bond impressions, the regular bond pattern having a percentage bond area of 10% to 25%; and hydraulically imparting the fully bonded precursor nonwoven web with a plurality of apertures, the step of hydraulically imparting comprising hydraulically treating the fully bonded precursor nonwoven web by pressing the calender-bonded precursor nonwoven web against a plurality of pins using hydraulic pressure of water injectors.

In an exemplary embodiment, each of the pins have a base portion and a top portion, where the area of the base portion is larger than the area of the top portion.

In an exemplary embodiment, each pin is symmetrical with respect to a longitudinal axis of the pin.

In an exemplary embodiment, each pin has a base, and distances between centers of immediately adjacent pins are at least 100% of a diameter of the base, preferably 150% of a diameter of the base.

In an exemplary embodiment, heights of the pins are at least 100% of a thickness of the apertured nonwoven web, preferably at least 115% of a thickness of the apertured nonwoven web, more preferably at least 130% of a thickness of the apertured nonwoven web.

In an exemplary embodiment, heights of the pins are at least 200% of a thickness of the precursor web, preferably at least 250% of a thickness of the precursor web, more preferably at least 300% of a thickness of the precursor web.

In an exemplary embodiment, the pins are arranged at a surface which moves at substantially the same speed as the calender bonded precursor nonwoven web.

In an exemplary embodiment, the pins vary in terms of size and/or shape and are arranged on a screen or belt, and the distance between centers of immediately adjacent pins are at least 100% of a diameter of the base of the largest of the pins, preferably at least 150% of a diameter of the base of the largest of the pins.

In an exemplary embodiment, the step of forming the precursor web comprises the spunmelt fibers of the nonwoven batt consisting of spunbond filaments.

In an exemplary embodiment, the step of forming the precursor web comprise the nonwoven batt comprising two or more layers.

In an exemplary embodiment, the step of forming the precursor web comprises the spunmelt fibers in each of the two or more layers comprising spunbond filaments.

In an exemplary embodiment, the step of forming the precursor web comprises an average fiber thickness difference between the layers being less than 20%, preferably less than 15%, more preferably less than 10%, even more preferably less than 5%.

In an exemplary embodiment, the step of forming the precursor web comprises at least one layer of the two or more layers comprising spunbond filaments and at least one other layer of the two or more layers comprising meltblown fibers.

In an exemplary embodiment, the step of forming the precursor web comprises at least one layer comprising spunbond filaments forming at least one outer layer of the nonwoven batt.

In an exemplary embodiment, the step of forming the precursor web comprises the nonwoven batt comprising three or more layers, and the three or more layers form a spunbond-meltblown-spunbond (SMS) structure.

In an exemplary embodiment, the method further comprises the step of applying at least one layer formed of fibers and/or particles to the fully bonded nonwoven precursor web before the step of hydraulically treating.

In an exemplary embodiment, the fibers are short synthetic fibers, preferably polyester based staple fibers or viscose fibers.

In an exemplary embodiment, the fibers are natural fibers, preferably cotton fibers or pulp or modified cellulose such as rayon.

In an exemplary embodiment, the step of forming the precursor web comprises the continuous spunmelt fibers being mono-component fibers formed of thermoplastic polymer, preferably polyolefin or polyester or polyamide based homopolymer, copolymer of polymer blend.

In an exemplary embodiment, the step of forming the precursor web comprises the continuous spunmelt fibers being multicomponent, preferably bicomponent, fibers and wherein each component is formed of thermoplastic polymer, preferably polyolefin or polyester or polyamide based homopolymer, copolymer of polymer blend.

In an exemplary embodiment, a component polymer composition present on at least 40% of each filament surface, preferably on at least 50% of each filament surface, more preferably on at least 60% of each filament surface, even more preferably covering an entirety of each filament surface has a melting temperature that is lower as compared to a melting temperature of at least one other component polymer composition, preferably with a difference of at least 2° C., more preferably with a difference of at least 5° C.

In an exemplary embodiment, the step of forming the precursor comprises the continuous spunmelt fibers comprising polyolefin or polyamide or polyester or polysaccharide homopolymer, copolymer or polymer blend.

In an exemplary embodiment, the step of forming the precursor web comprises the continuous spunmelt fibers comprising polypropylene, polyethylene, polylactic acid, polyhydroxyalkanoates, polyhydroxybutyrate, polybutylene succinate, polyethylene terephthalate, thermoplastic starch, their copolymers, their copolymers with olefins, esters, amides or other polymers or blends thereof.

In an exemplary embodiment, the step of forming the precursor web comprises the continuous spunmelt fibers being bicomponent core-sheath fibers with a core comprising polypropylene and a sheath comprising a blend of polypropylene and copolymer polypropylene-polyethylene.

In an exemplary embodiment, step of forming the precursor web comprises the continuous spunmelt fibers comprising additives.

In an exemplary embodiment, the additives comprise additives of a type selected from the group consisting of: color pigments, softness enhancers, slip agents, fillers and combinations thereof.

In an exemplary embodiment, the step of forming the precursor web comprises forming of bond impressions having a bond shape.

In an exemplary embodiment, the bond impressions have a first size and the bond impressions are formed of bond points or dots that have a second size, wherein the second size is less than the first size.

In an exemplary embodiment, the bond shape is oriented such that a line intersecting the bond shape perimeter along which the greatest measurable length exists and intersects an axis lying on a surface along the machine direction to form an angle $\alpha T$ of 0 degree to 65 degrees.

In an exemplary embodiment, the bond shape comprises a convex portion.

In an exemplary embodiment, the bond shape comprises a concave portion.

In an exemplary embodiment, the bond shape comprises at least one of a convex portion and a concave portion.

In an exemplary embodiment, the bond shape is asymmetric.

In an exemplary embodiment, the step of forming the precursor web comprises forming bond impressions in a quilted pattern.

In an exemplary embodiment, the bond impressions have a bond shape, and the bond shape is oval.

In an exemplary embodiment, the bond impressions have a bond shape, and the bond shape is line.

In an exemplary embodiment, the bond impressions have a bond shape with a bond shape perimeter having a greatest measurable length and a greatest measurable width.

In an exemplary embodiment, an aspect ratio of the greatest measurable length to the greatest measurable width is at least 1.0, preferably at least 1.5, more preferably of at least 2.0, even more preferably at least 2.5.

In an exemplary embodiment, the fully bonded nonwoven precursor web comprises at least 20 bonding impressions per square centimeter, preferably at least 40 bonding impressions per square centimeter, more preferably at least 50 bonding impressions per square centimeter and even more preferably at least 60 bonding impressions per square centimeter.

In an exemplary embodiment, a bonding impression line intersecting a bond shape perimeter along which the greatest measurable length exists and intersects an axis lying on the surface along the machine direction to form an angle $\alpha T$ of 20 degree to 80 degrees, preferably of 40 degree to 80 degrees and even more preferably of 50 degrees to 70 degrees.

In an exemplary embodiment, the step of forming the precursor web comprises forming of the fully bonded nonwoven precursor web with less than 20 bonding impressions per square centimeter, preferably less than 15 bonding impressions per square centimeter, more preferably less than 5 bonding impressions per square centimeter.

In an exemplary embodiment, the bonding impressions have a bond shape with a bond shape perimeter having a greatest measurable length and a greatest measurable width, and an aspect ratio of the greatest measurable length to the greatest measurable width is at least 2.0, more preferably at least 2.5, even more preferably at least 3.

In an exemplary embodiment, the bond shape is a line.

In an exemplary embodiment, the bond shape is S shape.

In an exemplary embodiment, the bonding impressions have a bond shape with a bond shape perimeter having a greatest measurable length and a greatest measurable width, and a bonding impression line intersecting the bond shape perimeter along which the greatest measurable length exists and intersects an axis lying on the surface along the machine direction to form an angle $\alpha T$ of 5 degree to 15 degrees, preferably of 8 degree to 12 degrees, and even more preferably of 9 degrees to 11 degrees.

In an exemplary embodiment, the step of forming the precursor web comprises forming bond impressions in a quilted pattern.

In an exemplary embodiment, the bonding impressions in a quilted pattern have a quilted pattern line that intersects an imaginary line extending in the machine direction to form an angle $\alpha Tq$ of 5 degree to 60 degrees, preferably of 10 degree to 50 degrees and even more preferably of 15 degrees to 40 degrees.

In an exemplary embodiment, the precursor nonwoven web has an MD HOM value of at least 5 g.

In an exemplary embodiment, the precursor nonwoven web has a CD HOM value of at least 2 g.

In an exemplary embodiment, the precursor nonwoven web has an MD HOM value of 30 g or less, preferably 25 g or less.

In an exemplary embodiment, the precursor nonwoven web has a CD HOM value of 20 g or less, preferably 15 g or less.

In an exemplary embodiment, the precursor nonwoven web has a basis weight of at least 5 gsm, preferably of at least 10 gsm, preferably of at least 15 gsm, more preferably of 20 gsm or less.

In an exemplary embodiment, the precursor nonwoven web has a basis weight of 60 gsm or less, preferably 50 gsm or less, more preferably 45 gsm or less, even more preferably of 35 gsm or less.

In an exemplary embodiment, the step of hydraulically treating comprises applying hydraulic pressure to the nonwoven precursor web with water injectors.

In an exemplary embodiment, the hydraulic pressure applied to the precursor web is expressed as energy flux of at least 0.2 kWh/kg, preferably of at least 0.3 kWh/kg.

In an exemplary embodiment, the hydraulic pressure applied to the precursor web is expressed as energy flux of 1.9 kWh/kg or less, preferably of 3.0 kWh/kg or less.

In an exemplary embodiment, the step of hydraulically treating comprises applying hydraulic pressure to the nonwoven precursor web by at least two sets of water injectors.

In an exemplary embodiment, the method is performed at a line speed of at least 150 m/min.

In an exemplary embodiment, the line speed is 450 m/min or less.

In an exemplary embodiment, the step of hydraulically treating comprises applying hydraulic pressure to the nonwoven precursor web by four sets of water injectors with each water injector applying a pressure of 150 bar or greater.

In an exemplary embodiment, the step of hydraulically treating comprises applying hydraulic pressure to the nonwoven precursor web by three sets of water injectors with each set of water injectors applying a pressure that is greater than a pressure applied by a set of water injectors preceding the set of water injectors in the machine direction.

In an exemplary embodiment, the three sets of water injectors comprise a first set of water injectors, a second set of water injectors preceding the first set of water injectors in the machine direction and a third set of water injectors preceding the first and second water injectors in the machine direction, the second set of water injectors apply a pressure of between 80% to 95% of the pressure applied by the first set of water injectors, and the third set of water injectors apply a pressure of between 64% to 90% of the pressure applied by the second set of water injectors.

In an exemplary embodiment, the step of hydraulically treating comprises applying hydraulic pressure to the nonwoven precursor web by three sets of water injectors with each water injector applying a pressure of 200 bar or greater.

In an exemplary embodiment, the step of hydraulically treating comprises applying hydraulic pressure to the nonwoven precursor web by two sets of water injectors with each water injector applying a pressure of 300 bar or greater.

In an exemplary embodiment, the step of hydraulically treating comprises water jets applied to the calender bonded precursor nonwoven web at an angle of 80 to 100° with respect to the calender bonded precursor nonwoven web.

In an exemplary embodiment, the step of hydraulically imparting the fully bonded precursor nonwoven web with a plurality of apertures comprises at least partially altering the individual bond impressions by application of water pressure.

In an exemplary embodiment, the step of at least partially altering results in at least 60% of fully bonded portions of the individual bond impressions remaining after the step of hydraulically imparting.

In an exemplary embodiment, the step of at least partially altering results in at least 70% of fully bonded portions of the individual bond impressions remaining after the step of hydraulically imparting.

In an exemplary embodiment, the step of at least partially altering results in at least 80% of fully bonded portions of the individual bond impressions remaining after the step of hydraulically imparting.

In an exemplary embodiment, the step of at least partially altering results in at least 90% of fully bonded portions of the individual bond impressions remaining after the step of hydraulically imparting.

In an exemplary embodiment, the step of at least partially altering results in separating the individual bond impressions into at least two portions.

In an exemplary embodiment, the step of at least partially altering results in fibers in areas around perimeters of the individual bond impressions randomly frayed in and out of a major plane of the fully bonded precursor nonwoven web so as to at least partially eliminate three-dimensionality of the individual bond impressions.

According to an exemplary embodiment, an apertured hydro-patterned nonwoven web is produced according to any of the aforementioned process steps.

In an exemplary embodiment, the apertured hydro-patterned nonwoven web has a basis weight of 60 gsm or less, preferably 50 gsm or less, more preferably 45 gsm or less, even more preferably 35 gsm or less.

In an exemplary embodiment, the apertured hydro-patterned nonwoven web has an MD tensile strength of at least 4 N/cm.

In an exemplary embodiment, the apertured hydro-patterned nonwoven web has a CD tensile strength of at least 2 N/cm.

In an exemplary embodiment, the apertured hydro-patterned nonwoven web has a caliper of at least 12 microns/gsm of fabric.

In an exemplary embodiment, the apertured hydro-patterned nonwoven web does not exhibit two sidedness.

In an exemplary embodiment, the apertured hydro-patterned nonwoven web does not exhibit visual two sidedness as viewed by the naked eye.

In an exemplary embodiment, the apertured hydro-patterned nonwoven web does not exhibit two sidedness in terms of abrasion rating.

In an exemplary embodiment, the apertured hydro-patterned nonwoven web does not exhibit two sidedness in terms of coefficient of friction.

In an exemplary embodiment, the apertured hydro-patterned nonwoven web has a visual aperture clarity of at least 3 on a scale of 1 to 5.

A method of forming an apertured hydro-patterned nonwoven web according to an exemplary embodiment of the present invention comprises: providing a fully bonded precursor nonwoven web with a regular bond pattern that defines individual bond impressions and unbonded areas between the individual bond impressions, the regular bond pattern having a percentage bond area of 10% to 25%; and hydraulically treating the fully bonded precursor nonwoven web by a plurality of steps of water injection as the fully bonded nonwoven web passes over a plurality of pins so as to form a plurality of apertures in the fully bonded precursor nonwoven web.

BRIEF DESCRIPTION OF THE DRAWINGS

The above and related objects, features and advantages of the present invention will be more fully understood by reference to the following, detailed description of the preferred, albeit illustrative, embodiment of the present invention when taken in conjunction with the accompanying figures, wherein.

DETAILED DESCRIPTION

Figure 1:
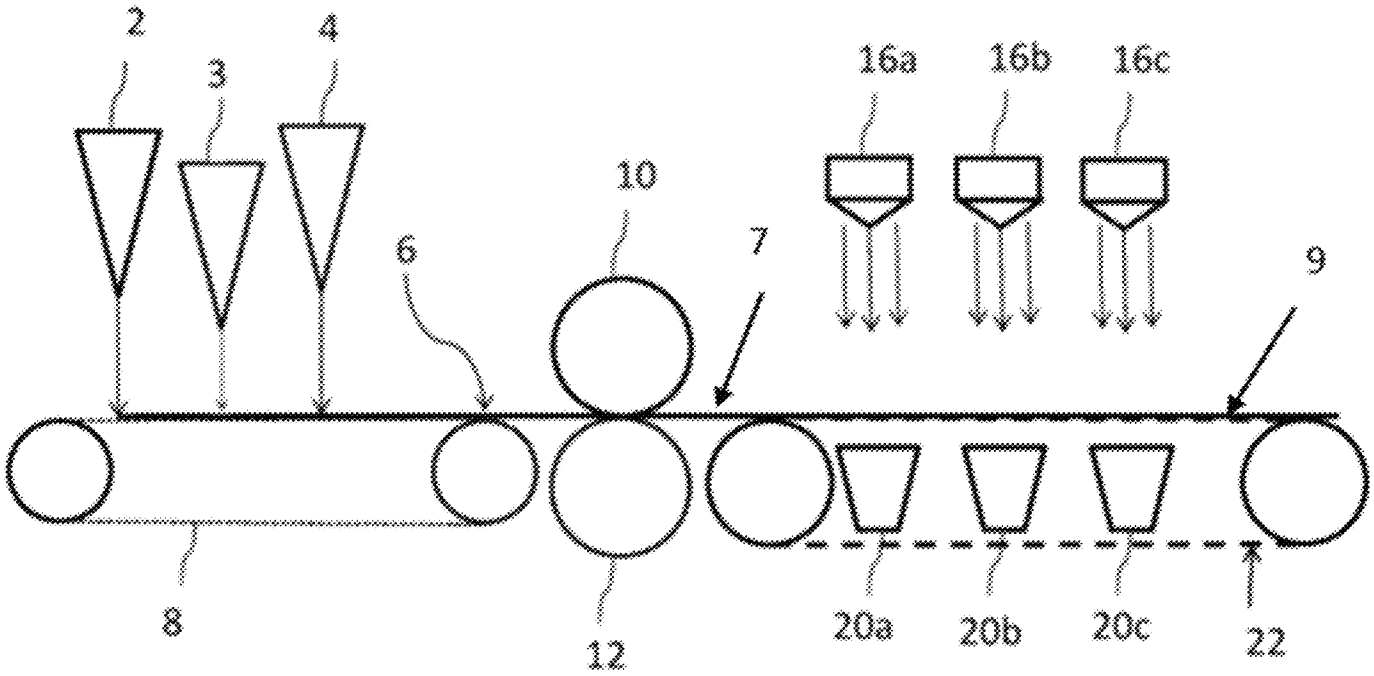
FIG. 1 is a representative diagram of a system of forming a patterned hydro-apertured nonwoven web according to an exemplary embodiment of the present invention.

The present invention is directed to improved techniques for hydraulically treating and imparting apertures to nonwoven fabrics and to nonwoven fabrics made using these methods.

A nonwoven web hydraulically treated and/or formed with an aperture pattern, in accordance with the present invention may be suitable for use in disposable absorbent articles. As used herein, the term "absorbent article" refers to articles which absorb and contain fluids and solid materials. For example, absorbent articles may be placed against or in proximity to the body to absorb and contain the various exudates discharged by the body. Absorbent articles may be articles that are worn, such as baby diapers, adult incontinence products, and feminine care products, or hygienic products that are used to absorb fluids and solid materials, such as for the medical profession which uses products like disposable gowns and chucks. In particular, nonwovens in accordance with exemplary embodiments of the present invention may be used as or as part of a body contacting layer of an absorbent article, such as a topsheet, or used to form other components of absorbent articles, such as, for example, a backsheet, waist belt, or fastening tabs. The nonwovens in accordance with exemplary embodiments of the present invention may also be used for packaging or wrapping items such as absorbent articles. The term "disposable" is used herein to describe absorbent articles which are not intended to be laundered or otherwise restored or reused as an absorbent article, but instead are intended to be discarded after a single use and, preferably, to be recycled, composted or otherwise disposed of in an environmentally compatible manner.

The term "batt" is used herein to refer to fiber materials prior to being bonded to each other. A "batt" comprises individual fibers, which are usually unbonded to each other, although a certain amount of pre-bonding between fibers may be performed, and this pre-bonding may occur during or shortly after the lay-down of fibres in a spun-melt process, for example. This pre-bonding, however, still permits a substantial number of the fibers to be freely movable such that they can be repositioned. A "batt" may comprise several layers, resulting by depositing fibers from several spinning heads in a spunmelt process, and distributions of a fiber diameter thickness and a porosity in the "sub layers" laid-down from individual heads do not differ significantly. Adjacent layers of fibers need not be separated from each other by a sharp transition, and individual layers may blend partly in the area around the boundary.

The terms "fibers" and "filaments" are used interchangeably in this application unless otherwise specified (such as "endless filaments" or "short fibers" etc).

The terms "nonwoven, nonwoven fabric, sheet or web" as used herein refer to a manufactured sheet or web of directionally or randomly oriented fibers or filaments which are first formed into a batt and then one or more batts are laid one on each other and consolidated and bonded together by friction, cohesion, adhesion or one or more patterns of bonds and bonding impressions created through localized compression and/or application of pressure, heat, ultrasonic, or heating energy, or a combination thereof. The term does not include fabrics which are woven, knitted, or stitch-bonded with yarns or filaments. The fibers may be of natural or man-made origin and may be staple or continuous filaments or be formed in situ. Commercially available fibers have diameters ranging from about 0.0005 mm to about 0.25 mm and they come in several different forms: short fibres (known as staple, or chopped), continuous single fibres (filaments or monofilaments), untwisted bundles of continuous filaments (tow), and twisted bundles of continuous filaments (yarn). Nonwoven fabrics can be formed by many processes including but not limited to melt-blowing, spun-bonding, spun-melting, solvent spinning, electro-spinning, carding, film fibrillation, melt-film fibrillation, air-laying, dry-laying, wet-laying with staple fibres and combinations of these processes as known in the art. The basis weight of nonwoven fabrics is usually expressed in grams per square meter (gsm).

The term "spunmelt fibers" refers to fibers formed by heating thermoplastic polymers (e.g., polypropylene, polyester or nylon) and extruding them through a metal plate with hundreds of holes in it, known as a spinneret or die. Examples of spunmelt fibers include spunbond fibers and meltblown fibers. Spunmelt fibers might be monocomponent in that they are formed of a single polymer component or a single blend of polymer components or multicomponent where the cross-section of each fiber comprises at least two discrete polymer components or blends of polymer components, or at least one discrete polymer component and at least one discrete blend of polymer components. Fibers with two discreet components may be referred to as bicomponent fibers.

Webs or fabrics made with spunmelt fibers may be referred to as "spunmelt webs or fabrics."

The term "spunbond fibers" as used herein means substantially continuous fibers or filaments having an average diameter in the range of 10-30 microns. Splitable bicomponent or multicomponent fibers having an average diameter in the range of 5-30 microns prior to splitting are also included.

The term "meltblown fibers" as used herein means substantially continuous fibers or filaments having an average diameter of less than 10 microns.

The measurement "filament diameter" or "fiber diameter" or "fiber thickness" is expressed in units of μm. The terms "filament diameter", "fiber diameter" and "fiber thickness" can be used interchangeably. The terms "number of grams of filament per 9000 m" (also denier or den) or "number of grams of filament per 10000 m" (dTex) are used to express the degree of fineness or coarseness of a filament as they relate to the filament diameter (a circular filament cross-section is assumed) multiplied by the density of the material or materials used.

The term "fully bonded nonwoven" as used herein, and as well understood by one skilled in the art, refers to a nonwoven that has fibers that are fused to one another at bonding impressions via melting and solidification. Such a fabric might be used itself for various applications, e.g., converted into a diaper, etc., or used as a precursor for further treatment (e.g., hydrophilic spin finish application or hydraulic treatment). For example, a fully calender bonded nonwoven may be produced by passing a batt through a nip point between two heated rolls under pressure, thereby providing a pattern of fused embossed impressions in the fabric. The pressure and temperature within the nip are sufficient to soften and melt the individual fibers and to then weld them together using a pattern of protrusions on at least one of the heated rolls to create a series of fused bonding impressions where the majority of fibers within the fused bonding impression can no longer be distinguished as individual fibers. The bonding impressions results in fusion of fibers or in the case of bicomponent fibers in fusion of at least one component with the lowest melting temperature through the full thickness of the fabric. The roll temperature and pressure are adjusted dependent upon fabric formulation and basis weight. For example, a 20-25 gsm 100% polypropylene homopolymer spunbond is typically bonded at roll temperatures of >150 deg C. and with a nip pressure greater than 90 N/mm. Temperature/pressure settings are adjusted to handle different basis weights and or line speeds. Higher basis weights and/or line speeds may require increased nip pressures and/or temperatures to achieve a "fully" bonded fabric with fused bond points. It should be appreciated that tack bonding is not within the scope of the definition of "fully bonded" for the purposes of this disclosure.

The term "bond area percentage" as used herein represents a ratio of an area occupied by bonding impressions to a total surface of a nonwoven fabric expressed as a percentage and measured according to the Bond Area Percentage Method set forth herein.

With respect to the making of a nonwoven web material and the nonwoven web material itself, "cross direction" (CD) refers to the direction along the web material substantially perpendicular to the direction of forward travel of the web material through the manufacturing line in which the web material is manufactured. With respect to a batt moving through the nip of a pair of calender rollers to form a bonded nonwoven web, the cross direction is perpendicular to the direction of movement through the nip, and parallel to the nip.

With respect to the making of a nonwoven web material and the nonwoven web material itself, "machine direction" (MD) refers to the direction along the web material substantially parallel to the direction of forward travel of the web material through manufacturing line in which the web material is manufactured. With respect to a nonwoven batt moving through the nip of a pair of calender rollers to form a bonded nonwoven web, the machine direction is parallel to the direction of movement through the nip, and perpendicular to the nip.

A "bonding protrusion" or "protrusion" is a feature of a bonding roller at its radially outermost portion, surrounded by recessed areas. Relative the rotational axis of the bonding roller, a bonding protrusion has a radially outermost bonding surface with a bonding surface shape and a bonding surface shape area, which generally lies along an outer cylindrical surface with a substantially constant radius from the bonding roller rotational axis; however, protrusions having bonding surfaces of discrete and separate shapes are often small enough relative the radius of the bonding roller that the bonding surface may appear flat/planar; and the bonding surface shape area is closely approximated by a planar area of the same shape. A bonding protrusion may have sides that are perpendicular to the bonding surface, although usually the sides have an angled slope, such that the cross section of the base of a bonding protrusion is larger than its bonding surface. A plurality of bonding protrusions may be arranged on a calender roller in a pattern. The plurality of bonding protrusions has a bonding area per unit surface area of the outer cylindrical surface which can be expressed as a percentage, and is the ratio of the combined total of the bonding shape areas of the protrusions within the unit, to the total surface area of the unit.

A "bonding impression" or "fused bonding impression" in a nonwoven web is the structure created by the impression of a bonding protrusion on a calender roller into a nonwoven web. A bonding impression is a location of deformed, intermeshed or entangled, and melted or thermally fused, materials from fibers superimposed and compressed in a z-direction beneath the bonding protrusion, which form a bond or a bonding area. The individual bonds may be connected in the nonwoven structure by loose fibres between them. The shape and size of the bonding impression approximately corresponds to the shape and size of the bonding surface of a bonding protrusion on the calender roller. For the purposes of this disclosure a "bonding impression thickness" is understood to mean a width of a bonding impression area in a nonwoven web plane. One or both of the rollers may have their circumferential surfaces machined, etched, engraved or otherwise formed to have thereon a bonding pattern of bonding protrusions and recessed areas, so that bonding pressure exerted on the batt at the nip is concentrated at the bonding surfaces of the bonding protrusions, and is reduced or substantially eliminated at the recessed areas. The bonding surfaces have bonding surface shapes. As a result, an impressed pattern of bonds between fibers forming the web, having bond impressions and bond shapes corresponding to the pattern and bonding surface shapes of the bonding protrusions on the roller, is formed on the nonwoven web. A repeating pattern of bonding protrusions and recessed areas may be formed onto a bonding roller. The bonding shapes depict raised surfaces of bonding protrusions on a roller, while the areas between them represent recessed areas. The bonding shapes of the bonding protrusions impress like-shaped bond impressions on the web in the calender bonding (or calendering) process.

FIG. 1 is a block diagram showing various components used in a process for making an apertured nonwoven web according to an exemplary embodiment of the present invention. Although the process shown in FIG. 1 results in a nonwoven web having an SMS structure (2; 3; 4), it should be appreciated that the process may be re-configured to form many other web structures comprising one or more spunbond layers and/or one or more meltblown layers, such as, for example, fabrics with single or multiple spunbond layers, more specific examples being S, SS, SSS, etc.; fabrics with a combination of spunbond and meltblown layers, typically with a spunbond layer forming at least one outer surface of the fabric, more specific asymmetric composition examples being SSMS, SMSSMMS, SSMMS, SMMMSS etc. fabrics or symmetric examples being SMS, SMMS, SMMMS, SSMSS etc. fabrics; fabrics combining spunmelt layers with other layers, more specific examples being a combination of spunmelt layers formed of endless filaments with short fibers formed from natural materials, etc. The nonwoven web structure is not limited to the examples provided herein, and one of ordinary skill in the art would understand that many other such structures may be obtained by varying the number and arrangement of process components.

In general, it should be appreciated that the number and configuration of beams is not limited to that shown and described herein, and in other exemplary embodiments, the number and configuration of beams may be varied to achieve different web structures. For example, a single spunbond beam may be used to form nonwoven batt 6 on conveyor belt 8 having a single spunbond layer, or multiple spunbond beams may be used to form batt 6 having a multi-spunbond layer structure, such as, for example SS, SSS, SSSS, etc. Layers formed by multiple beams might be the same or very similar to each other in terms of filament-type, process parameters, etc. so that the layers are substantially indistinguishable from one another to thereby form what appears to be a single layer structure or they might be produced differently from one another thereby forming an evidently layered nonwoven product.

In another exemplary embodiment, only spunbond beam 2 and meltblown beam 3 are used to form nonwoven batt 6 on conveyor belt 8. According to further exemplary embodiments of the invention, plural elements corresponding to beams 2, 3 may be incorporated in the system to form batt 6 with multiple respective layers, such as, for example SM, SMM, SSM, SSMM etc. Again, layers formed by multiple beams, typically multiple beams of same type, might be the same or very similar to each other in terms of filament-type, process parameters, etc. so that the layers are substantially indistinguishable from one another to thereby form what appears to be a single layer structure or they might be produced differently from one another thereby forming an evidently layered nonwoven product.

According to an exemplary embodiment of the invention, a spunmelt nonwoven batt 6 is made of continuous filaments that are laid down on a moving conveyor belt 8 in a randomized distribution. Resin pellets may be processed under heat into a melt and then fed through a spinneret (or spinning beams 2 and 4) to create hundreds of filaments by use of a drawing device (not shown). Multiple spinnerets or beams (blocks in tandem) may be used to provide an increased density of spunbond fibers corresponding to, for example, each of spinning beams 2 and 4. Jets of a fluid (such as air) cause the fibers from beams 2 and 4 to be elongated, and the fibers are then blown or carried onto a moving web (conveyor belt) 8 where they are laid down and sucked against the web 8 by suction boxes (not shown) in a random pattern to create a batt 6. A meltblown layer may be deposited by a meltblown mechanism (or "beam") 3, preferably between spunbond layers laid by spinning beams 2 and 4. The meltblown ("MB") layer can be formed by a meltblown process but may be formed by a variety of other known processes. For example, the meltblowing process includes inserting a thermoplastic polymer into a die. The thermoplastic polymer material is extruded through a plurality of fine capillaries in the die to form fibers. The fibers stream into a high velocity gas (e.g. air) stream which attenuates the streams of molten thermoplastic polymer material to reduce their diameter, which may be to the microfiber diameter. The meltblown fibers are quasi-randomly deposited by beam 3 over the moving web or moving web with spunbond layer laid by spinning beam 2 to form a meltblown layer. One, two or more meltblown blocks may be used in tandem in order to increase the coverage of fibers. The meltblown fibers can be tacky when they are deposited, which generally results in some bonding between the meltblown fibers of the web.

In a preferred embodiment, the fibers used to form batt 6 are thermoplastic polymers, examples of which include polyolefins (e.g. polypropylene "PP" or polyethylene "PE"), polyesters (e.g., polylactic acid "PLA" or polyhydroxyalkanoates "PHA" or polyhydroxybutyrate "PUB" or polybutylene succinate "PBS" or polyethylene terephthalate "PET", etc.), polyamides, polysaccharides (e.g. thermoplastic starch "TPS" or starch based polymers, etc.) copolymers thereof (with olefins, esters, amides or other monomers) and blends thereof. Preferably the fibers are made from polyolefins, examples of which include polyethylene, polypropylene, propylene-butylene copolymers thereof and blends thereof, including, for example, ethylene/propylene copolymers and polyethylene/polypropylene blends. Resins with higher crystallinity and lower break elongations may also be suitable due to likelihood to fracture with greater ease. Fibers might be also formed, for example, from non-oil-based components, such as aliphatic polyesters, thermoplastic polysaccharides or other biopolymers, or they may contain these substances as additives or modifiers. As used herein, the term "blend" includes a homogeneous or semi-homogenous mixture of at least two polymers.

Another approach has involved forming a nonwoven web of multicomponent or preferably "bicomponent" polymer fibers. Such bicomponent polymer fibers may be formed by spinnerets that have two adjacent sections, that express a first component from one polymer or blend and a second component from the other, to form a fiber having a cross section of the first component in one portion and the second component in the other (hence the term "bicomponent"). The respective components may be with advantage selected to have differing melting temperatures and/or expansion-contraction rates. These differing attributes of the two polymers, when combined in a side by side or asymmetric sheath-core geometry might cause the bicomponent fiber products to curl in the spinning process, as they are cooled and drawn from the spinnerets. The resulting curled fibers then may be laid down in a batt and calender bonded in a pattern. It is thought that the curl in the fibers adds loft and fluff to the web, enhancing visual and tactile softness signals.

Other formulation changes may also be employed, e.g., addition of $CaCO_3$, to provide a spunbond fiber that is more prone to fracture and/or permanent deformation and, thus, provide improved aperturing. One skilled in the art would appreciate many other formulation changes, such as, for example, color additives, process additives, filament surface modulators, such as, for example, softness enhancers, etc., dependent on further requirements of the final fabric properties or specific spunmelt line requirements.

In an exemplary embodiment, batt 6 may be thermally calender-bonded via rollers 10 and 12. One or both rollers 10 and 12 may have their circumferential surfaces machined, etched, engraved or otherwise formed to have thereon a pattern of protrusions and recessed areas, so that bonding pressure exerted on the batt 6 at the nip is concentrated at the outward surfaces of the protrusions, and reduced or substantially eliminated at the recessed areas. According to an exemplary embodiment of the invention, roller 10 is a calender roll and roller 12 is a bonding roll defining a bond pattern. The thermal calender bonding results in a fully bonded precursor web 7. Preferred bond patterns in accordance with exemplary embodiments of the present invention are described further below.

In accordance with an exemplary embodiment of the invention, precursor nonwoven web 7 is then hydraulically treated using multiple water jet injectors 16*a*, 16*b*, and 16*c*. Each of elements 16*a*, 16*b*, and 16*c* illustrated in FIG. 1 may represent a set of plural injectors in a respective predetermined arrangement. According to an exemplary embodiment of the invention, as precursor nonwoven web 7 is conveyed under the injectors 16*a-c* by a belt 22, high pressure water jets of the injectors 16*a*, 16*b*, 16*c* act against and pass through the fabric. In an exemplary embodiment, the belt 22 comprises a pattern of pins for imparting apertures to the precursor nonwoven web 7. According to an exemplary embodiment of the invention, the pins have a base, and a distance between centers of immediately adjacent pins is at least 100% of a diameter of the base, and in a preferred exemplary embodiment, 150% of a diameter of the base.

Corresponding water removal systems 20*a*, 20*b*, and 20*c* may be positioned under the location of each injector (set) 16*a-c* to pull the water away and dry the precursor fabric 7. The water removal systems 20*a*, 20*b* and 20*c* may include, for example, vacuum boxes, suction boxes, Uhle boxes, fans and/or vacuum slots. Nonwoven precursor web 7 may subsequently be dried by blowing hot air through the fibrous web, by IR dryers or other drying techniques (e.g., air drying).

According to an exemplary embodiment of the invention, belt 22 may incorporate one or more screens (not shown) each with a predetermined pattern for supporting precursor nonwoven web 7 while it is being hydraulically treated by respective water injectors 16*a*-16*c*. As explained in further detail below with reference to FIGS. 2A and 2B, the one or more screens may be replaced with one or more drums 14, with the one drum or the last drum in a series of drums provided with a sleeve 18. The screen(s) or sleeve may comprise a pattern of pins for imparting apertures to the precursor nonwoven web 7. According to exemplary embodiments of the invention, fewer than three sets of injectors 16*a*-16*c* may be used for hydraulically treating and/or imparting apertures to precursor nonwoven web 7.

In accordance with an exemplary embodiment of the invention, the use of one or more drums, with the one drum or the last drum in a series of drums having a sleeve provided with a pattern of pins, and further with each drum being associated with one or more water injectors, results in a plurality of steps of water injection. The desired water pressure at each step depends on a number of parameters, including the number of water injection steps and the line speed. In general, the more water injection steps used in the process, the less pressure is required at each step to achieve the desired fabric properties. In other words, the energy flux attained using a number of water injectors each applying an amount of water pressure can also be attained by increasing the number of water injectors and decreasing the amount of water pressure applied by each injector. The desired water pressure at each step also depends at least partially on the line speed. Higher line speed requires higher pressure to maintain constant flux. In other words, the energy flux attained using a line speed and injector pressure can also be attained by reducing both the line speed and injector pressure.

Without being bound by theory, it is believed the preferred total water jet pressure applied to the precursor web 7 may be expressed in terms of energy flux. In accordance with an exemplary embodiment, the preferred energy flux applied to the precursor web 7 is at least 0.2 kWh/kg, preferably at least 0.3 kWh/kg, preferably at least 0.5 kWh/kg, preferably within the range of 0.2-3.0 kWh/kg, preferably within the range of 0.3-1.9 kWh/kg and also preferably within the range of 0.5-1.9 kWh/kg. The desired energy flux may be obtained by, for example, varying machine speed and/or water pressure at each water injector. Preferably, the desired energy flux is achieved by using one or more water injectors at a relatively lower pressure rather than less water injectors at a higher pressure. Energy flux may be calculated using the following formula:

$$Flux = \frac{J^{1.5} \times G^2 * I * \frac{L}{1*10^3} * \frac{7}{1*10^{10}}}{F} \text{ kWh/kg}$$

In exemplary embodiments in which a series of drums are used, the pins on the last drum in the process line provide the entire aperturing of the precursor web 7. In this regard, the drums before the last drum in the process line are preferably not provided with pins, but instead may be provided with mesh screens. In an exemplary embodiment, the second to last drum in a line of drums may be provided with pins to prepare the precursor fabric for aperturing, but again the actual opening/aperturing of the precursor fabric 7 preferably occurs at the last drum. It should be appreciated that in other exemplary embodiments of the present invention, the pins may be provided on a belt rather than on a drum.

Preferred exemplary embodiments of the present invention involve the use of a relatively large amount of water injectors. Without being bound by theory, the use of a larger amount of injectors allows for higher line speed without having to increase injector pressure. It should be noted, that for the purposes of the present disclosure, two or more water injectors with the same settings (especially concerning number and geometry of water jets and the water pressure) are considered a single water injector.

In an exemplary embodiment, the plurality of steps of water injection may include exposing the fully calender-bonded polyolefin based nonwoven precursor web 7 to a plurality of water injectors with each water injector applying a pressure of 180 bar, preferably 200 bar or greater. In exemplary embodiments, the basis weight of the precursor web 7 is 15 gsm to 45 gsm and the line speed is 150 to 450 meters/minute, with a more specific example in which the precursor web has a basis weight of 25 gsm and the line speed is 200 meters/minute.

In an exemplary embodiment, the plurality of steps of water injection may include exposing the fully calender-bonded polyolefin based nonwoven precursor web 7 to two water injectors with each water injector applying a pressure of 250 bar, preferably 300 bar or greater. In exemplary embodiments, the basis weight of the precursor web 7 is 15 gsm to 45 gsm and the line speed is 150 to 450 meters/minute, with a more specific example in which the precursor web has a basis weight of 25 gsm and the line speed is 200 meters/minute.

In an exemplary embodiment, the plurality of steps of water injection may include exposing the fully calender-bonded polyolefin based nonwoven precursor web 7 to at least four water injectors with each water injector applying a pressure of 150 bar or greater. In exemplary embodiments, the basis weight of the precursor web 7 is 15 gsm to 45 gsm and the line speed is 150 to 450 meters/minute, with a more specific example in which the precursor web has a basis weight of 25 gsm and the line speed is 200 meters/minute.

In an exemplary embodiment, the plurality of steps of water injection may include exposing the fully calender-bonded polyester based nonwoven precursor web 7 to at least three water injectors applying a pressure of 60 bar, preferably 75 bar or greater. In exemplary embodiments, the basis weight of the precursor web 7 is 15 gsm to 45 gsm and the line speed is 150 to 450 meters/minute, with a more specific example in which the precursor web has a basis weight of 25 gsm and the line speed is 200 meters/minute.

In exemplary embodiments, the plurality of steps of water injection includes exposing the fully calendar-bonded nonwoven precursor web 7 to three water injectors (with each water injector having a set of injectors/nozzles), with each water injector applying a higher amount of pressure as compared to an immediately preceding water injector in the machine direction. For example, the water injector 16*c* may apply a higher pressure as compared to the water injector 16*b*, and the water injector 16*b* may apply a higher pressure as compared to the water injector 16*a*. In a specific exemplary embodiment, the water injector 16*b* applies pressure in the amount of at least 80%, preferably 80% to 95% of the pressure applied by water injector 16*c*, and the water injector 16*a* applies pressure in the amount of at least 80%, preferably 80% to 95% of the pressure applied by water injector 16*b*. In embodiments, the water injector 16*a* applies pressure in an amount of at least 64%, preferably 64% to 90% of the pressure applied by water injector 16*c*. The relatively low pressure applied by water injector 16*a* results in initial softening of the precursor web without opening of apertures, the higher pressure applied by the water injector 16*b* prepares the precursor web for aperturing by beginning to alter the individual bond impressions (as explained in further detail below) and the final water injector 16*c* in the machine direction applying the highest amount of pressure creates the apertures in the precursor web and further alters the individual bond impressions. Without being bound by theory it is believed that the rising gradient in applied pressure helps to preserve individual bond impressions in the softening and preparation stages of the process and allows for controlled altering of individual bond impressions together with creation of apertures at the last stage.

In embodiments, the plurality of steps of water injection includes exposing the fully calendar-bonded nonwoven precursor web 7 to two water injectors (with each water injector having a set of injectors/nozzles), with each water injector applying a higher amount of pressure as compared to an immediately preceding water injector in the machine direction. For example, the water injector 16*c* may apply a higher pressure as compared to the water injector 16*b*, and the water injector 16*a* may be excluded.

In embodiments, the plurality of steps of water injection includes exposing the fully calendar-bonded nonwoven precursor web 7 to four or more water injectors (with each water injector having a set of injectors/nozzles), with each water injector applying a higher amount of pressure as compared to an immediately preceding water injector in the machine direction.

In exemplary embodiments, the step of hydraulically imparting the fully bonded precursor nonwoven web with a plurality of apertures comprises at least partially altering the individual bond impressions by application of water pressure. In this regard, application of water pressure may result in removal of at least some of the fully bonded portions of the individual bond impressions so that at least 60%, preferably at least 70%, more preferably 80%, and even more preferably 90% of the fully bonded portions of the individual bond impressions remain after the step of hydraulically imparting.

In embodiments, application of water pressure may result in separation of the individual bond impressions into at least two portions. In embodiments, application of water pressure may result in reduction in overall size of the individual bond impressions while maintaining the general profile of the individual bond impressions. For example, as shown in FIGS. 20A-20B, 22A and 22B, in the case of oval bond impressions (e.g., Pattern 1), the alteration may result in reduction in size of the oval shape while maintaining the general oval profile of the bonding impression. As a further example, as shown in FIGS. 21A-21B, 23A and 23B, in the case of S-shape bond impression (e.g., Pattern 3) with bonding areas in the shape of relatively narrow line forming an S-shape, the alteration may result in separation of the S-shaped line into several portions. Without being bound by theory, it is believed that the at least partial alteration of the individual bond impressions results in tactile softness improvement and does not significantly reduce tensile strength and/or abrasion resistance of the final product. Tactile softness is a complex value that is hard to express by simple measurement, as it represents the feeling provided by human fingers. Values measured in this application (caliper, HOM, COF) are partial measurements of tactile softness and their values do not express tactile softness in its complexity.

Figure 19B:
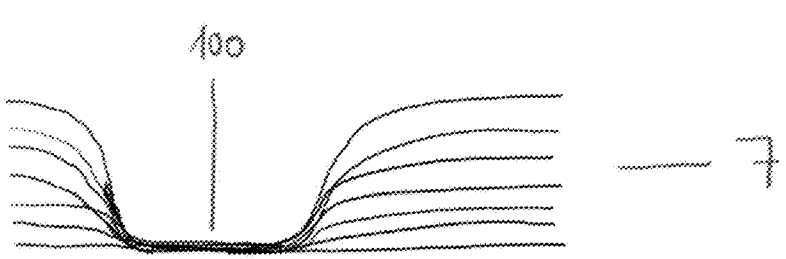
FIGS. 19A-19D shows alteration of an individual bond impression in cross-section resulting from the process of exemplary embodiments of the present invention.
Figure 19A:
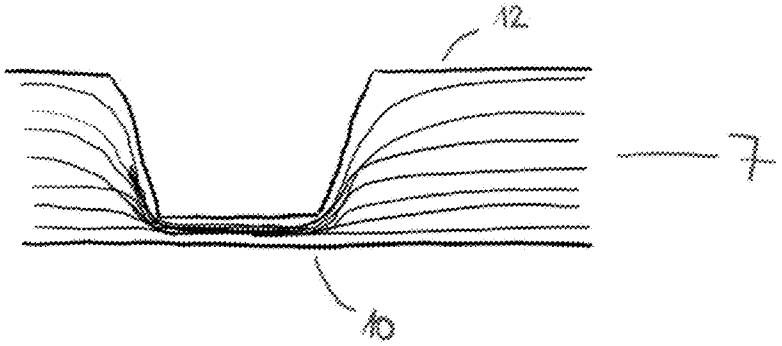
Figure 19C:
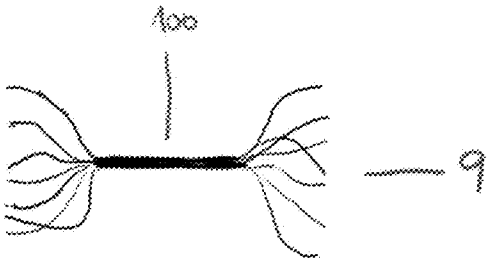
Figure 19E:
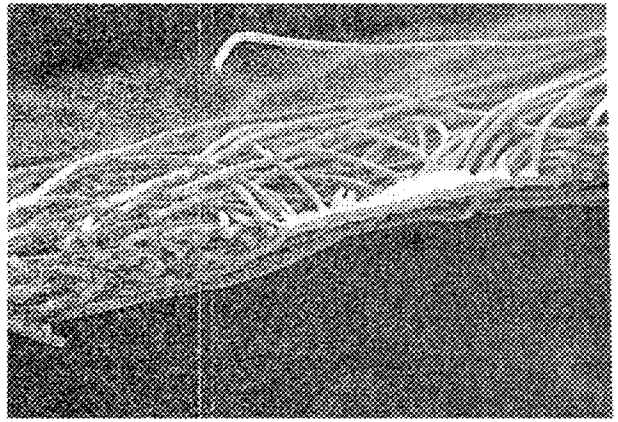
FIGS. 19E and 19F are micrographs showing alteration of an individual bond impression in cross-section resulting from a conventional hydraulic treatment process.
Figure 19F:
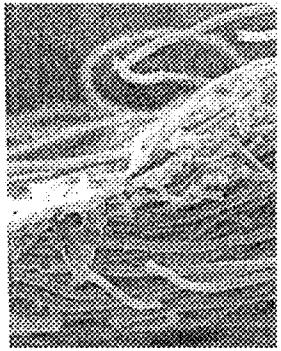
Figure 19D:
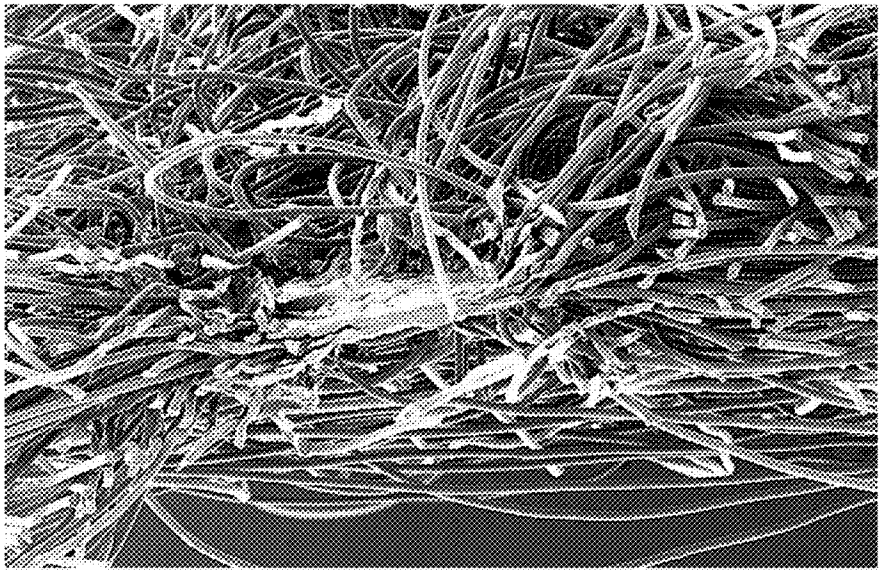
Figure 20B:
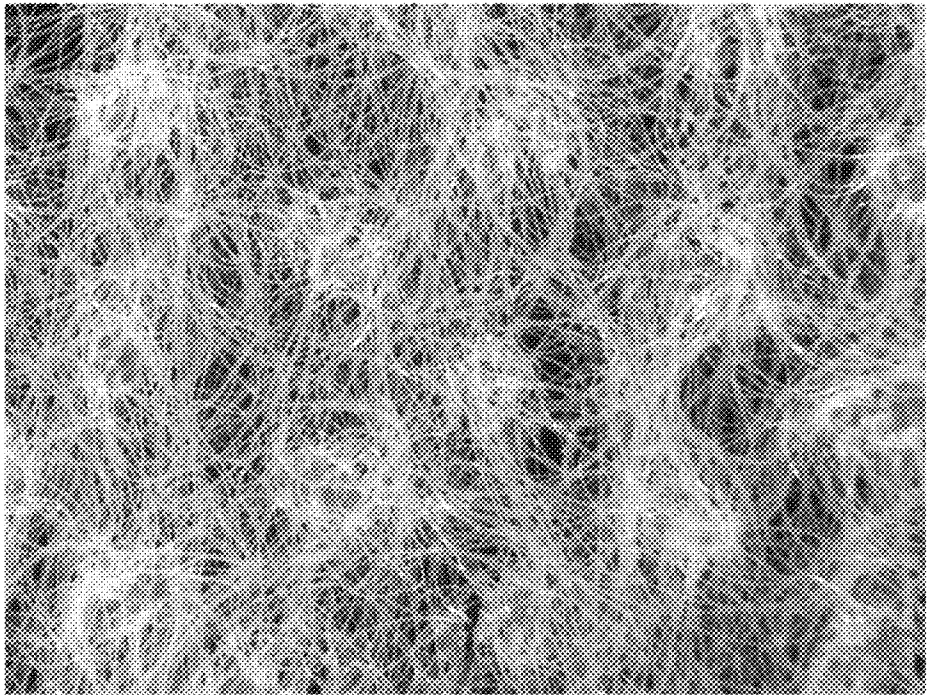
FIGS. 20A-20B are photographs showing a planar view of a patterned hydro-apertured nonwoven web as made in accordance with Example 8 described herein.
Figure 20A:
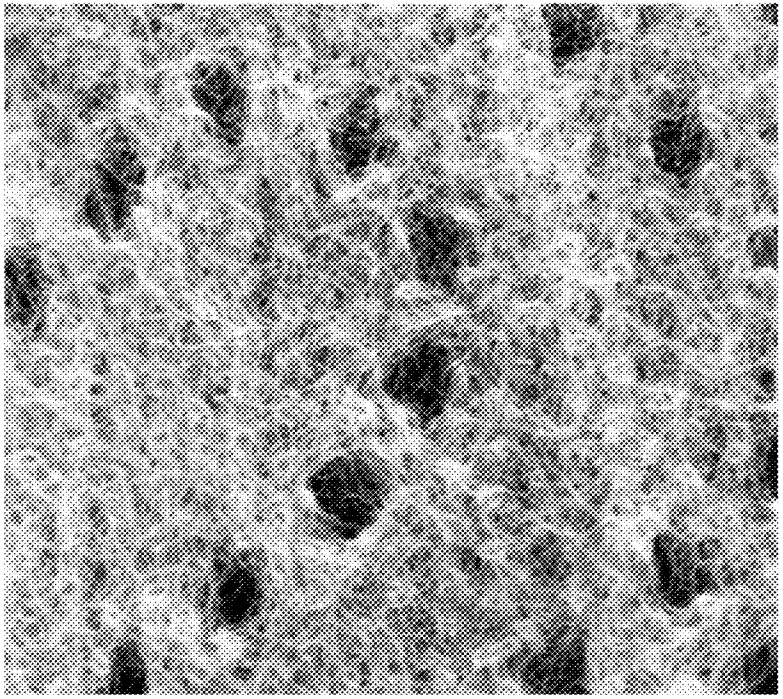
Figure 21B:
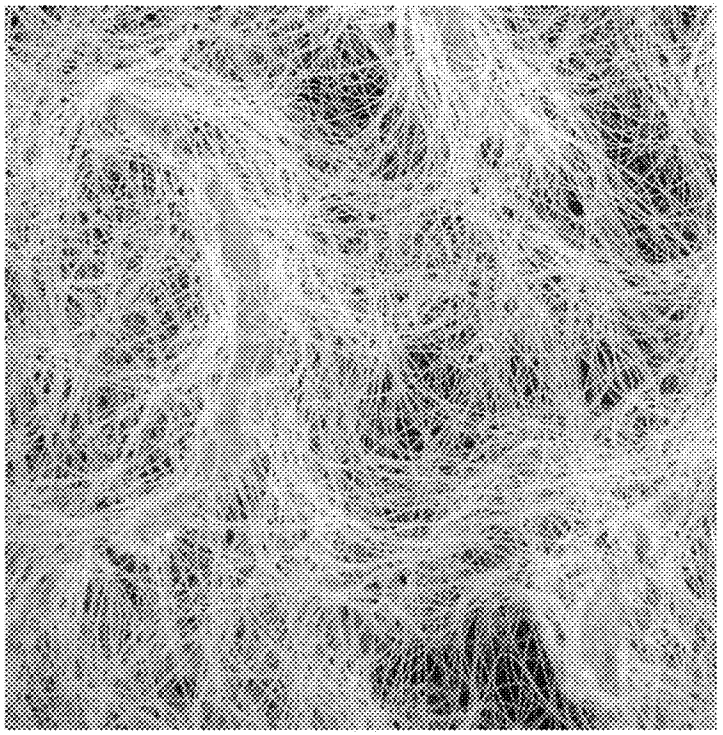
FIGS. 21A-21B are photographs showing a planar view of a patterned hydro-apertured nonwoven web as made in accordance with Example 9 described herein.
Figure 21A:
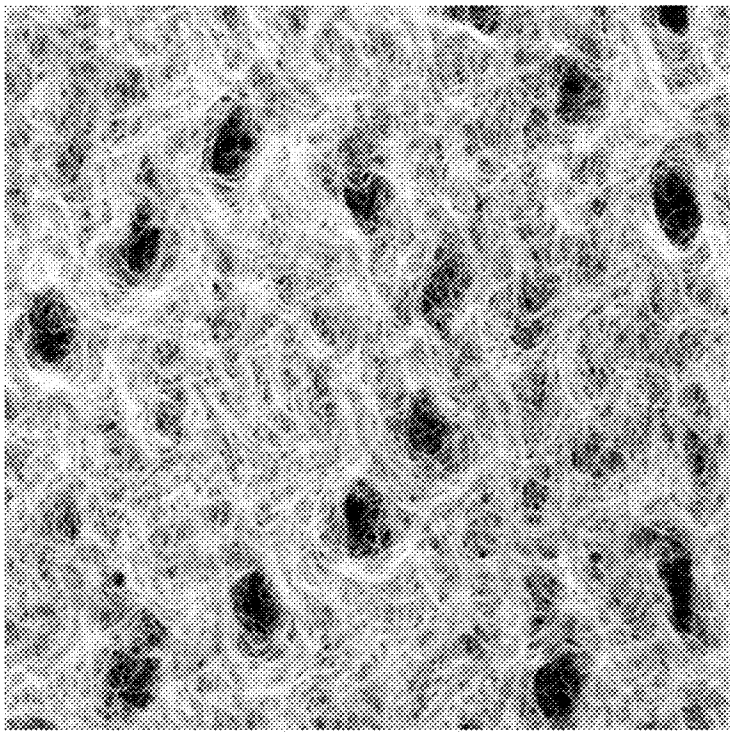
Figure 23A:
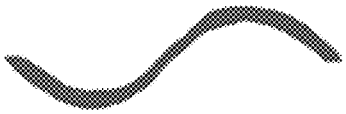
FIGS. 23A and 23B illustrate planar views of a patterned nonwoven web before and after hydraulic treatment in accordance with an exemplary embodiment of the present invention.
Figure 23B:
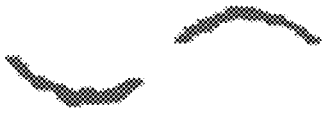
Figure 22A:
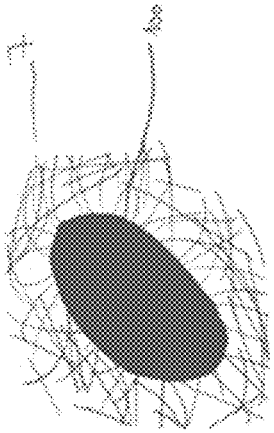
FIGS. 22A and 22B illustrate planar views of a patterned nonwoven web before and after hydraulic treatment in accordance with an exemplary embodiment of the present invention.
Figure 22B:
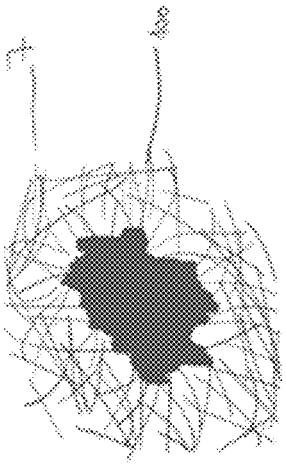

In embodiments, as shown in FIGS. 19A-19F, application of water pressure results in fibers in areas around perimeters of the individual bond impressions being randomly frayed in and out of a major plane of the fully bonded precursor nonwoven web so as to at least partially remove naturally reinforced fibers around the perimeters of the bond impressions to thereby at least partially eliminate the three-dimensionality of the individual bond impressions. More specifically, FIG. 19A is a cross-sectional view showing formation of an individual bond impression with a patterned calender roll 12 and smooth calender 10 with naturally reinforced fibers at the bond impression edge, FIG. 19B is a cross-sectional view of the bonded precursor web with an individual bond impression 100 and naturally reinforced fibers at the bonding impression edge, and FIG. 19C is a cross-sectional view showing the hydraulically treated nonwoven web with an altered individual bond impression where there are no naturally reinforced fibers at the bonding impression edge and also the bonding impression itself is slightly smaller. FIG. 19D is a micrograph of a cross-section of an altered individual bond impression according to an exemplary embodiment of the present invention showing how the hydraulic treatment results in frayed edges around the bond impression with no naturally reinforced fibers around the bond impression perimeter. In contrast, FIGS. 19E and 19F are micrographs of a cross-section of a conventional precursor bonding impression as shown in U.S. Pat. No. 8,410,007, where the naturally reinforced fibers are clearly visible.

Without being bound by theory, it is believed that the randomization of fibers around the perimeter of the individual bond impressions results in softer final product (tactile softness).

Figure 2A:
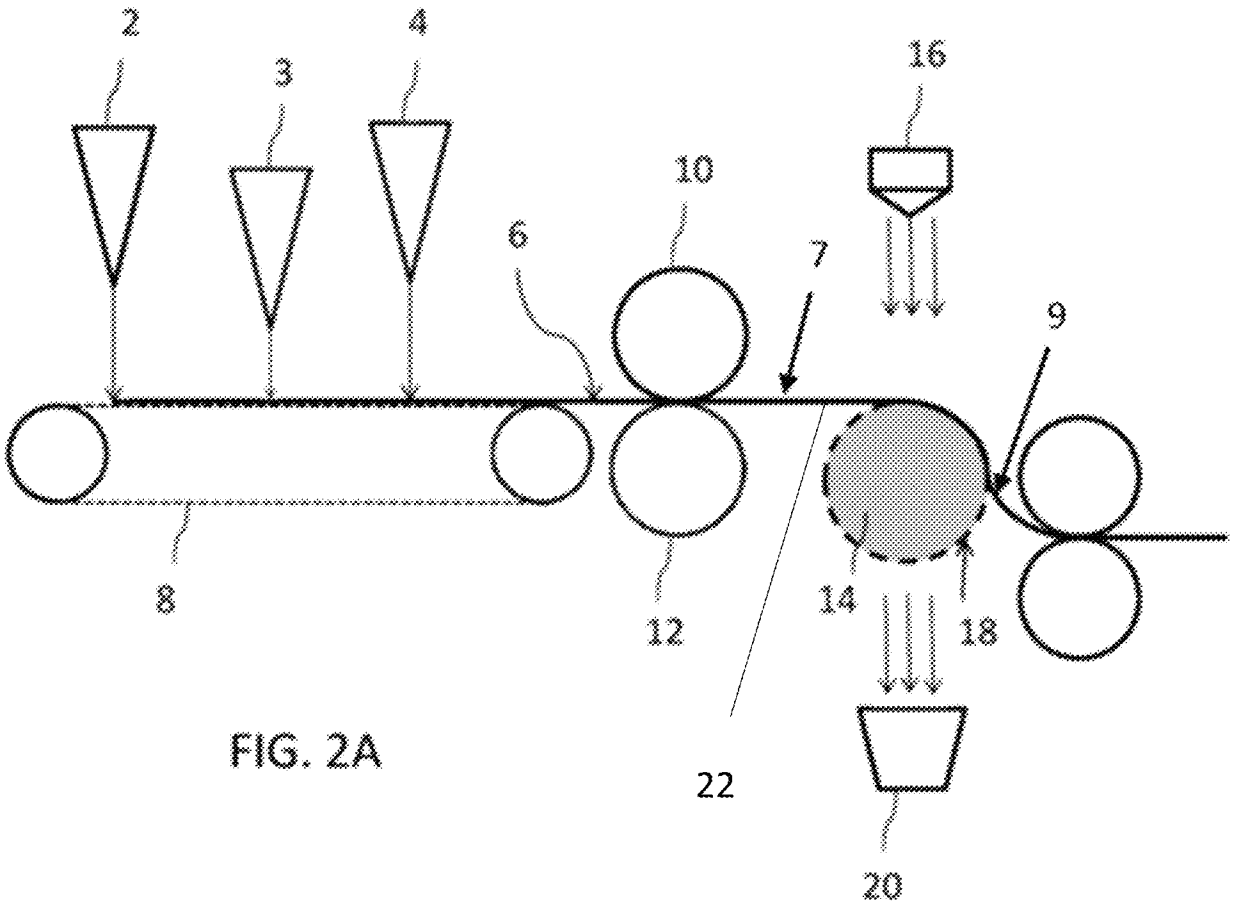
FIG. 2A is a representative diagram of a system of forming a patterned hydro-apertured nonwoven web according to another exemplary embodiment of the present invention.
Figure 2B:
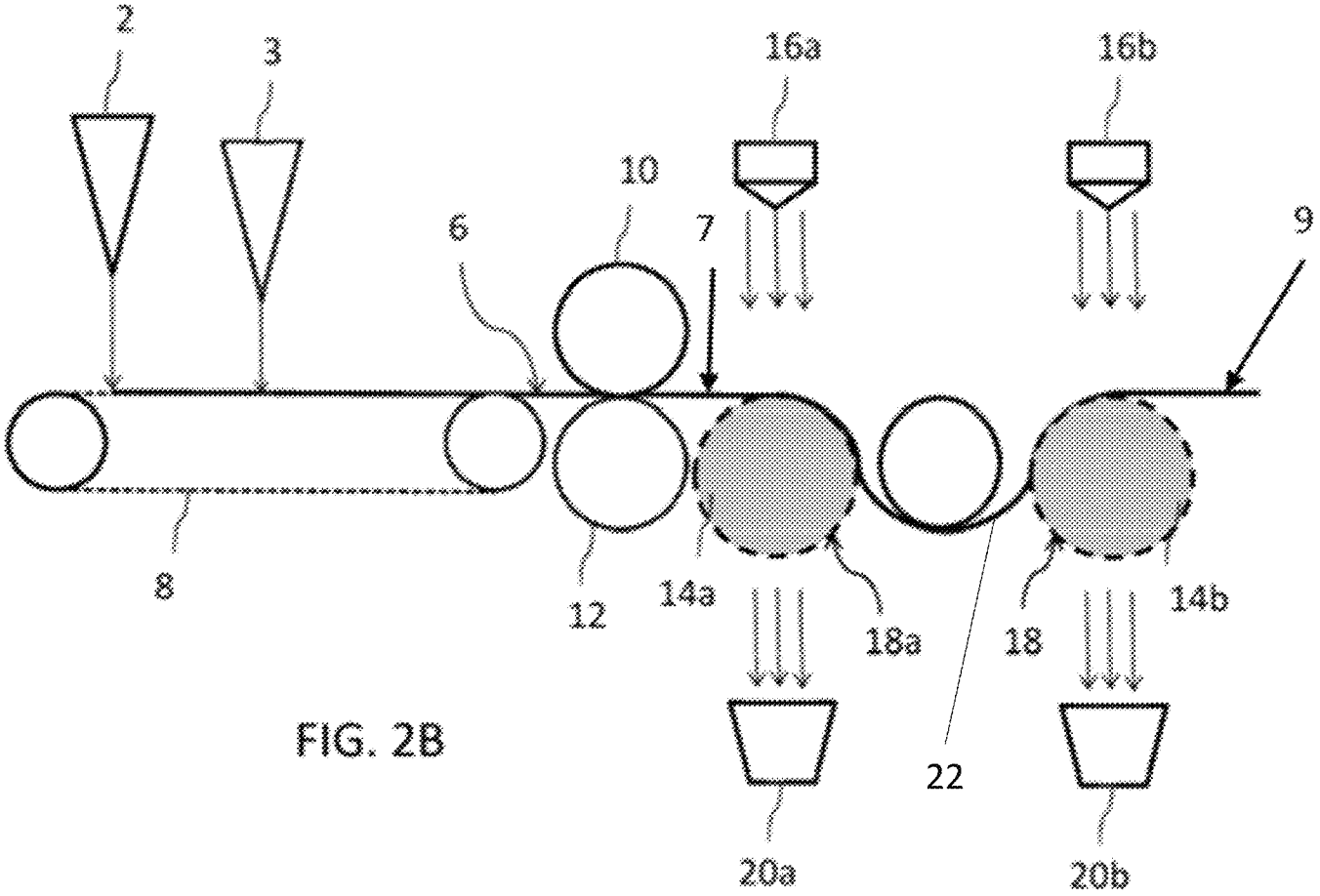
FIG. 2B is a representative diagram of a system of forming a patterned hydro-apertured nonwoven web according to another exemplary embodiment of the present invention.

FIGS. 2A and 2B illustrate exemplary embodiments of the invention employing one or plural drums for imparting apertures in a nonwoven fabric. Like elements are labeled with the same reference numerals as those in FIG. 1 and repeated detail description of these elements is omitted here.

As shown in FIG. 2A, spunbond beam 2, meltblown beam 3 and spunbond beam 4 may be used to form batt 6 on conveyor belt 8. The batt 6 may then be bonded with calender rolls 10 and 12 to form a fully-bonded precursor nonwoven 7. Again, according to further exemplary embodiments of the invention, plural elements corresponding to each of beams 2, 3, 4 may be incorporated in the system to form multiple respective layers of batt 6 by, for example, depositing multiple meltblown layers to form an SM or SMS type of fabric. It should be appreciated that the number, type and arrangement of beams are not limited to those described and shown herein, and it should be appreciated that any other combination of meltblown, spunbond, and/or meltblown/spunbond web structures may be formed in accordance with exemplary embodiments of the present invention by varying the number, type and/or arrangement of beams.

Figure 3:
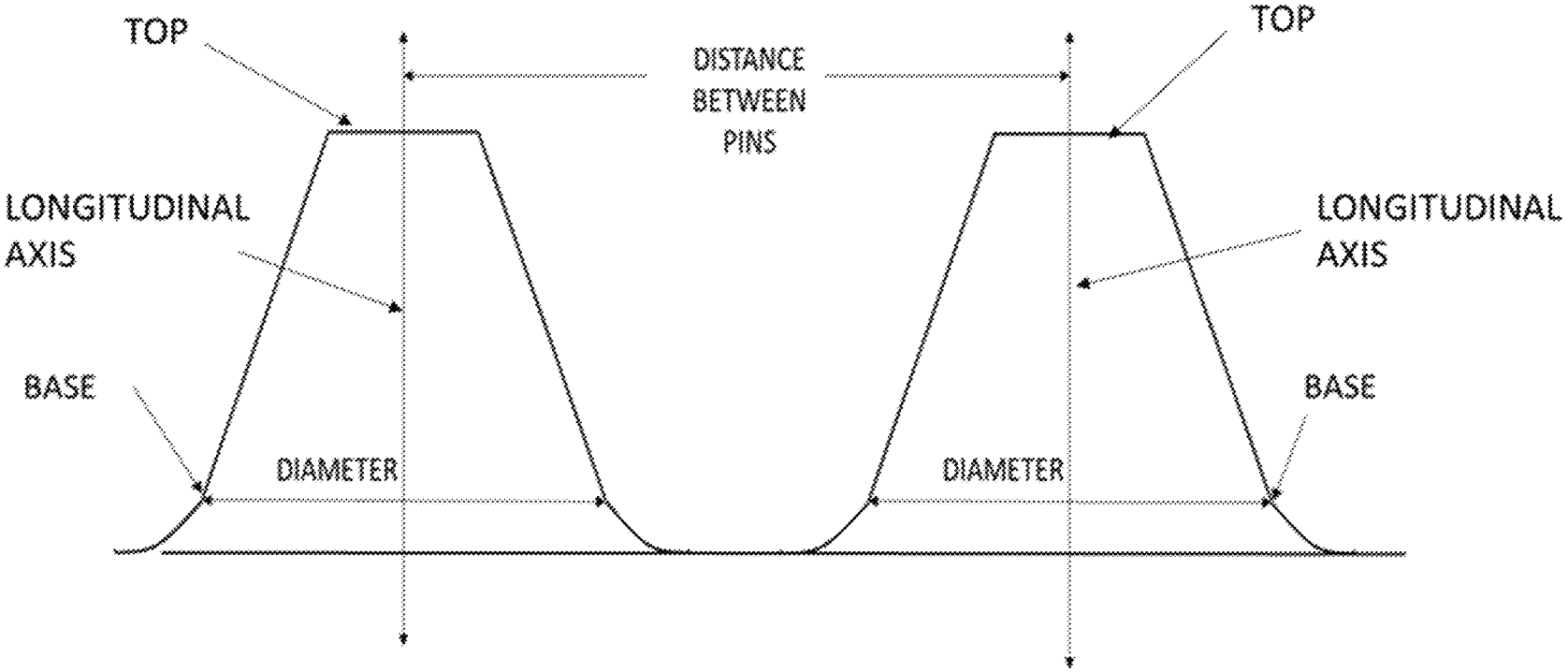
FIG. 3 is a diagram showing various dimensions of pins according to an exemplary embodiment of the present invention.

In accordance with an exemplary embodiment of the invention, apertures are then hydraulically imparted to nonwoven precursor web 7 by passing web 7 around drum 14 as one or more water injectors 16 apply pressurized water to the web 7. According to an exemplary embodiment of the invention, drum 14 may be covered with a sleeve 18, which may be made with metal or plastic, having a predetermined pattern of pins that form apertures in the precursor fabric/web 7 under the influence of the water pressure applied by the water injectors 16. According to an exemplary embodiment of the invention, the pins have a base, and a distance between centers of the pins is at least 100% of a diameter of the base, preferably of at least 150% of a diameter of the base, more preferably at least 200% of the diameter of the base. For the purposes of this measurement, the base is taken to mean the portion of the pin just before the pin begins to flare outwards into contact with the flat portions of the sleeve, as shown in FIG. 3. In situations where the pin base is not circular, the "diameter" is taken to mean the length of the shortest dimension across the pin base (for example, if the pin has an oval shape, the "diameter" would be the length of the minor axis of the oval).

Precursor nonwoven web 7 is wrapped around the drum 14 and as it passes under the injectors 16, high pressure water jets of the injectors 16 act against the fabric and pass through the fabric to deform the fabric according to the pin pattern on the sleeve 18. A water removal system 20 may be positioned under the location of each injector 16 to pull the water away, or through the apertures, thereby forming apertures in the precursor fabric (web 7) in a pattern corresponding to that of the pins on the sleeve 18 below the fabric 7. The apertured nonwoven web 9 may subsequently be dried by blowing hot air through the fibrous web, by IR dryers or other drying techniques (e.g., air drying).

In accordance with exemplary embodiments of the invention, heights of the pins are at least 100% of a thickness of the apertured nonwoven web, preferably at least 115% of a thickness of the apertured nonwoven web, more preferably at least 130% of a thickness of the apertured nonwoven web, wherein the thickness of the apertured nonwoven web is measured on a final dry product. The height of the pins for the purposes of this disclosure is taken to mean the height as measured from the base of the pin as described above to the top of the pin.

In accordance with exemplary embodiments of the invention, heights of the pins are at least 150% of a thickness of the precursor, preferably at least 200% of a thickness of the precursor web, preferably at least 250% of a thickness of the precursor web, more preferably at least 300% of a thickness of the precursor web wherein the thickness of the precursor nonwoven web is measured on a dry precursor before entering the water treatment.

As shown in FIG. 2A, aperturing may be done on one drum 14 with at least one, preferably multiple, water jet beams (injectors 16) so that subsequent drums will not disrupt the clarity of the aperturing pattern.

In accordance with an exemplary embodiment of the invention, the use of the single drum 14 in FIG. 2A having a sleeve provided with a pattern of pins, with the single drum 14 being associated with one or more water injectors, results in a plurality of steps of water injection. The desired water pressure at each step depends on the number of water injection steps. In accordance with an exemplary embodiment, the preferred energy flux applied to the precursor web 7 is within the range of 0.2-3.0 kWh/kg, preferably within the range of 0.3-1.9 kWh/kg. The desired energy flux may be obtained by, for example, varying machine speed and/or water pressure at each water jet. Preferably, the desired energy flux is achieved by using one or more water injection stations at a relatively low pressure rather than less water injection stations at a higher injector pressure.

In an exemplary embodiment, the plurality of steps of water injection may include exposing the fully calender-bonded nonwoven precursor web 7 as the web 7 travels around the single drum 14 to a three sets of water injectors with each water injector applying a pressure of 200 bar or greater. In exemplary embodiments, the basis weight of the precursor web 7 is 15 gsm to 45 gsm and the line speed is 150 to 450 meters/minute, with a more specific example in which the precursor web has a basis weight of 25 gsm and the line speed is 200 meters/minute.

In an exemplary embodiment, the plurality of steps of water injection may include exposing the fully calender-bonded nonwoven precursor web 7 as the web 7 travels around the single drum 14 to two sets of water injectors with each water injector applying a pressure of 250 bar or greater. In exemplary embodiments, the basis weight of the precursor web 7 is 15 gsm to 45 gsm and the line speed is 150 to 450 meters/minute, with a more specific example in which the precursor web has a basis weight of 25 gsm and the line speed is 200 meters/minute.

In an exemplary embodiment, the plurality of steps of water injection may include exposing the fully calender-bonded nonwoven precursor web 7 as the web 7 travels around the single drum 14 to at least four sets of water injectors with each water injector applying a pressure of 150 bar or greater. In exemplary embodiments, the basis weight of the precursor web 7 is 15 gsm to 45 gsm and the line speed is 150 to 450 meters/minute, with a more specific example in which the precursor web has a basis weight of 25 gsm and the line speed is 200 meters/minute.

FIG. 2B shows a system for imparting apertures to a nonwoven web using more than one drum according to an exemplary embodiment of the present invention. As shown in FIG. 2B, spunbond beam 2 and meltblown beam 3 may be used to form batt 6 on conveyor belt 8. The batt 6 may then be bonded with calender rolls 10 and 12 to form a fully-bonded precursor nonwoven web 7. Again, according to further exemplary embodiments of the invention, plural elements corresponding to each of beams 2, 3 may be incorporated in the system to form multiple respective layers of batt 6—for example, depositing multiple meltblown layers to form an SMMS or SMMMS fabric. Again, it should be appreciated that the number, type and arrangement of beams are not limited to those described and shown herein, and it should be appreciated that any other combination of meltblown, spunbond, and/or meltblown/spunbond web structures may be formed in accordance with exemplary embodiments of the present invention by varying the number, type and/or arrangement of beams.

As shown in FIG. 2B, the process in accordance with this exemplary embodiment involves the use of two drums, first drum 14*a* and second drum 14*b*, where second drum 14*b* follows first drum 14*a* along the process line. It should be appreciated that the number of drums is not limited to two, and any number of drums may be used. In accordance with an exemplary embodiment of the invention, apertures are hydraulically imparted to nonwoven precursor web 7 by passing web 7 around drum 14*b* (the last drum in the line of two drums) as one or more water injectors 16*b* apply pressurized water to the web 7. According to an exemplary embodiment of the invention, drum 14*b* may be covered with a sleeve 18, which may be made with metal or plastic, having a predetermined pattern of pins that form apertures in the precursor fabric/web 7. According to an exemplary embodiment of the invention, the pins have a base, and a distance between centers of the pins is at least 100% of a diameter of the base, preferably of at least 150% of a diameter of the base, more preferably at least 200% of the diameter of the base.

Precursor web 7 is wrapped around the drum 14*a* and 14*b*, and as the web 7 passes under the injectors 16*b* associated with the second drum 14*b*, high pressure water jets of the injectors 16*b* act against the fabric and pass through the fabric to deform the fabric according to the pin pattern on the sleeve 18. A water sink or vacuum slot/area 20*a*, 20*b* may be positioned under the location of each injector 16*a*, 16*b* to pull the water away, or through the apertures, thereby forming apertures in the precursor fabric (web 7) in a pattern corresponding to that of the pins on the sleeve 18 below the fabric 7. The apertured nonwoven web 9 may subsequently be dried by blowing hot air through the fibrous web, by IR dryers or other drying techniques (e.g., air drying).

The entirety of the aperturing is preferably performed at the second (last in line) drum 14*b* with at least one, preferably multiple, water jet beams (injectors 16*b*) so that subsequent drums will not disrupt the clarity of the aperturing pattern. In this regard, the drums before the last drum (for example, drum 14*a*) in the process line are preferably not provided with pins, but instead may be provided with mesh screens. In an exemplary embodiment, the second to last drum in a line of drums may be provided with pins to prepare the precursor fabric for aperturing, but again the actual opening/aperturing of the precursor fabric 7 preferably occurs at the last drum.

In accordance with an exemplary embodiment of the invention, the use of only the last drum 14*b* (in the line of drums) having a sleeve provided with a pattern of pins, with the drum 14*b* being associated with one or more water injectors, results in a plurality of steps of water injection. The desired water pressure at each step depends on the number of water injection steps. In accordance with an exemplary embodiment, the preferred energy flux applied to the precursor web 7 is within the range of 0.2-3.0 kWh/kg, preferably within the range of 0.3-1.9 kWh/kg. The desired energy flux may be obtained by, for example, varying machine speed and/or water pressure at each water jet. Preferably, the desired energy flux is achieved by using one or more water injection stations at a more moderate pressure rather than less water injection stations at a higher injector pressure.

In an exemplary embodiment, the plurality of steps of water injection may include exposing the fully calender-bonded nonwoven precursor web 7 as the web 7 travels around the drum 14*b* to three water injectors with each water injector applying a pressure of 300 bar or greater. In exemplary embodiments, the basis weight of the precursor web 7 is 15 gsm to 45 gsm and the line speed is 150 to 450 meters/minute, with a more specific example in which the precursor web has a basis weight of 25 gsm and the line speed is 200 meters/minute.

In an exemplary embodiment, the plurality of steps of water injection may include exposing the fully calender-bonded nonwoven precursor web 7 as the web 7 travels around the drum 14*b* to two water injectors with each water injector applying a pressure of 250 bar or greater. In exemplary embodiments, the basis weight of the precursor web 7 is 15 gsm to 45 gsm and the line speed is 150 to 450 meters/minute, with a more specific example in which the precursor web has a basis weight of 25 gsm and the line speed is 200 meters/minute.

In an exemplary embodiment, the plurality of steps of water injection may include exposing the fully calender-bonded nonwoven precursor web 7 as the web 7 travels around the drum 14*b* to at least four water injectors with each water injector applying a pressure of 150 bar or greater. In exemplary embodiments, the basis weight of the precursor web 7 is 15 gsm to 45 gsm and the line speed is 150 to 450 meters/minute, with a more specific example in which the precursor web has a basis weight of 25 gsm and the line speed is 200 meters/minute.

Without being bound by theory, it is believed that precursor nonwoven web properties have a strong influence on final fabric features. The fully bonded precursor nonwoven web is exposed to hydro-patterning as discussed herein, which forces the fibers in the web to shape around the pins on the screen through movement of fibers, breakage and/or inelastic deformation. This shape remains in the web and therefore provides a desired level of aperture clarity together with improvements in other attributes, such as, for example, softness, mechanical stability, etc. Important features of the precursor nonwoven according to exemplary embodiments of the present invention are described below.

In an exemplary embodiment, the precursor nonwoven web may have a Bond Area Percentage preferably at least 5%, preferably at least 10%, more preferably in the range of 10% to 25%. The "Bond Area Percentage" on a nonwoven web is a ratio of area occupied by bond impressions, to the total surface area of the web, expressed as a percentage, and measured according to the Bond Area Percentage method set forth herein. The method for measuring Bond Area Percentage is described in U.S. Pat. No. 8,841,507, the contents of which are herein incorporated by reference in their entirety, and also described below.

In an exemplary embodiment, the precursor nonwoven web may have a bond pattern made up of a number of bonding impressions, with each bonding impression having a greatest measurable length and a greatest measurable width.

Figure 4:
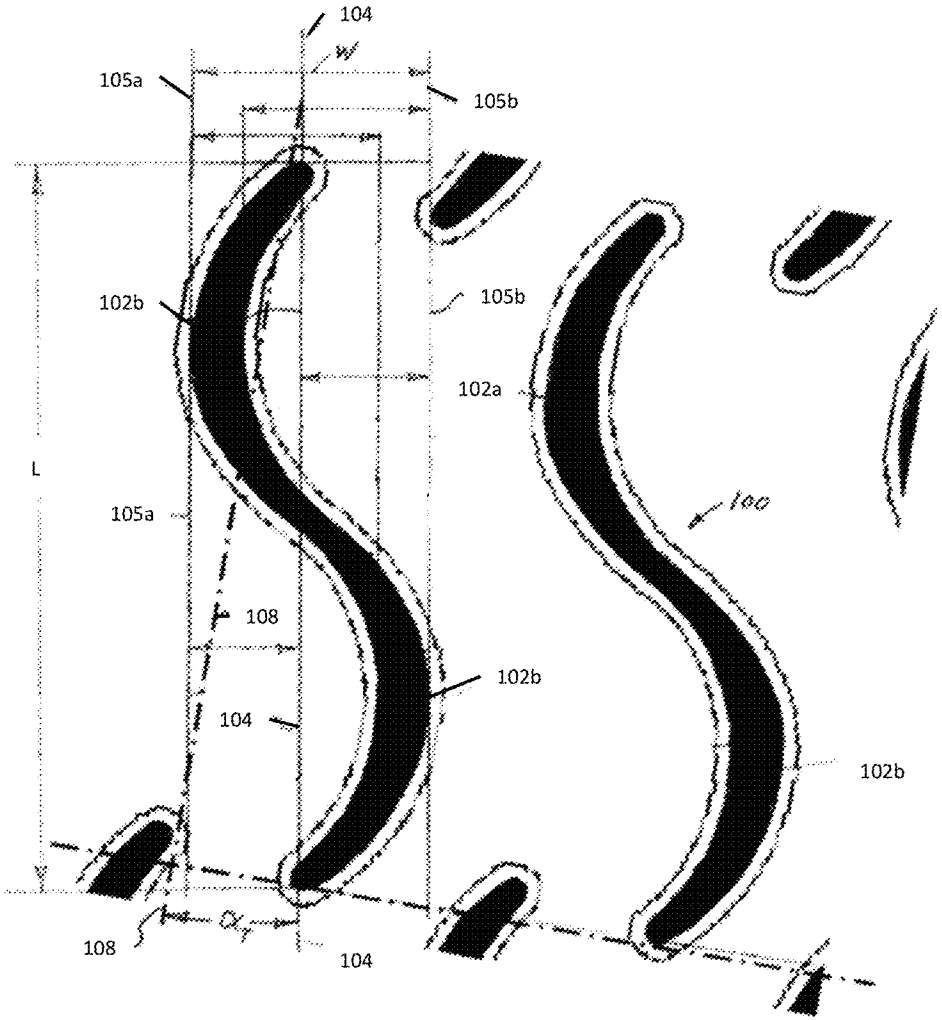
FIG. 4 is a diagram showing various dimensions of a bonding impression according to an exemplary embodiment of the present invention.

FIG. 4 shows a bonding pattern, referred to herein as "Pattern 3", on a precursor nonwoven web according to an exemplary embodiment of the present invention. The bonding shape 100 of each bonding impression has a greatest measurable length L, which is measured by identifying a shape length line 104 intersecting the perimeter of the shape at points of intersection that are the greatest distance apart that may be identified on the perimeter, i.e., the distance between the two farthest-most points on the perimeter. The bonding shape 100 has a greatest measurable width W which is measured by identifying respective shape width lines 105*a*, 105*b* which are parallel to shape length line 104 and tangent to the shape perimeter at one or more outermost points that are most distant from shape length line 104 on either side of it, as reflected in FIG. 4. It will be appreciated that, for some shapes (e.g., a semicircle), one of shape width lines 105*a*, 105*b* may be coincident/colinear with shape length line 104. The greatest measurable width W is the distance between shape width lines 105*a*, 105*b*.

Shapes within the scope of the present invention have an aspect ratio of greatest measurable length L to greatest measurable width W of at least 1.0, preferably of at least 1.5, more preferably of at least 2.0, even more preferably of at least 2.5. For example, an oval within a pattern of ovals (referred to herein as a "Pattern 1") in accordance with an exemplary embodiment of the present invention has an aspect ratio of greatest measurable length L to greatest measurable width W of 1.8, and a straight line within a pattern of straight lines (referred to herein as "Pattern 2") has an aspect ratio of greatest measurable length L to greatest measurable width W of 8.5. The bond shapes and sizes impressed on the nonwoven web will reflect and correspond with the bonding shapes 100 and sizes thereof on the calender roller.

Without intending to be bound by theory, it is believed that calender roller bonding protrusions having bonding shapes with one or more features as described herein have aerodynamic effects on air flow in and about the calender nip, that cause acceleration and deceleration of air in and about the interstices of the nonwoven fibers in a way that repositions the fibers. This repositioning of fibers may effect teasing or fluffing that can be advantageous in terms of forming aperture shape around pins during the hydro-patterning processes as described herein.

Additionally, the rotational orientations of the protrusions have an aerodynamic effect. In an exemplary embodiment, patterns with spaced bonding impressions have bonding shapes 100 and the bonding protrusions supporting them may be arranged along an individual shape tilt angle relative the machine and cross directions. Without intending to be bound by theory, it is believed that the shape tilt angle should not exceed a certain amount for the bonding protrusion to have maximum beneficial effect on air flow. Referring again to FIG. 4, the shape tilt angle $\alpha T$ may be expressed as the smaller angle formed by the intersection of an axis along the machine direction 108 and the shape length line 104. It is believed that the shape and the shape tilt angle have cooperating effects on the air flow. It is believed that the shape tilt angle $\alpha T$ provides the desired effects on air flow, such that it then should not exceed 65 degrees, more preferably, 40 degrees, and still more preferably, 30 degrees. It is believed that a shape tilt angle within this range effectively provides air flow through the nip, while at the same time, imparts cross-direction vector components to air flows through the nip. Conversely, a shape tilt angle greater than 50 degrees may create too much of an obstruction to air flow through the nip to have a beneficial effect, and even greater shape tilt angles combined with sufficient density of bonding protrusions may have the effect of creating enough obstruction at the nip to substantially divert airflow from the nip, i.e., toward the sides of the bonding rollers, rather than through the nip. The bond shapes and rotational orientations impressed on the nonwoven web will reflect and correspond with the bonding shapes and rotational orientations on the roller.

In other exemplary embodiments of the present invention, bonding impressions form a so called "quilted pattern." For the purposes of the present description, a nonwoven with a quilted pattern is one that has relatively large and regularly spaced unbonded areas. The unbonded areas are formed by the intersection of bond lines that extend from the opposite edges of the nonwoven and cross the fabric usually in a diagonal direction. The bond lines are spaced apart from each other so that they leave an unbonded area between the lines. In exemplary embodiments, the surface area of the unbonded area is larger than the thickness of the bond lines as measured across the surface of the fabric. For example, referring to FIG. 9 (Pattern 4), which shows a quilted pattern, the square shapes between the bond lines have a surface area that is preferably at least 3 times the thickness of the bond lines, preferably at least 4 times the thickness of the bond lines, most preferably at least 5 times the thickness of the bond lines. The bond lines may be formed by either unbroken lines or by individual bond points that are arranged in a consistent direction.

Figure 5:
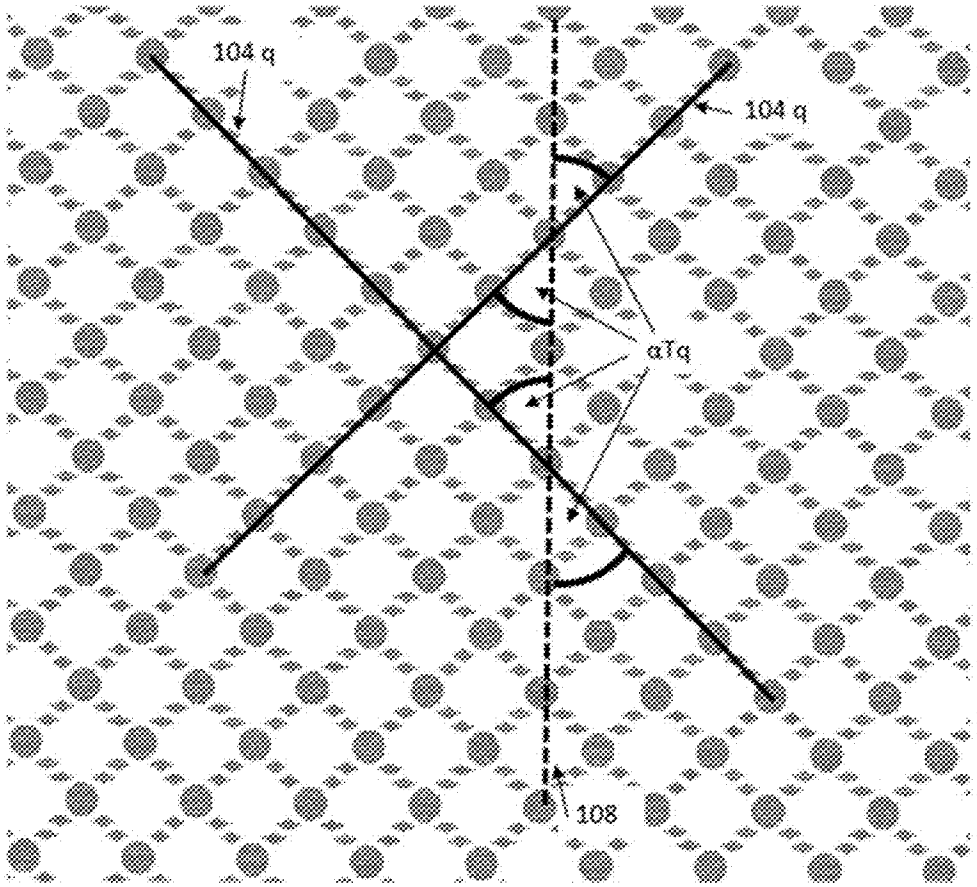
FIG. 5 is a diagram showing various dimensions of a bonding impression according to an exemplary embodiment of the present invention.

For quilted patterns, without being bound by theory, it is believed that the quilted pattern tilt angle αTq provides the desired effects on air flow, such that it then should not exceed 60 degrees, more preferably, 50 degrees, and still more preferably, 40 degrees. Referring to FIG. 5, the pattern tilt angle αTq may be expressed as the smaller angle formed by the intersection of an axis along the machine direction 108 and the quilted pattern line 104*q*.

Without being bound by theory, it is believed that a less homogenous filament direction in microscale tends to form more stable aperture edges in all directions. In contrast, a more homogenous microscale orientation might tend to form apertures with a higher density of filaments on the aperture edges aligned in a preferred direction. It is believed that, for best results, it may be even more desirable that the quilted pattern tilt angle αTq is between 5 degrees and 15 degrees, more preferably between 8 degrees and 12 degrees, and even more preferably between 9 degrees and 11 degrees. The rotational orientation of the bonding pattern impressed on the nonwoven web will reflect and correspond with the rotational orientation of the bonding pattern on the roller.

Still referring to FIG. 4, a bonding shape 100 may have a shape perimeter with convex portions 102*a*, 102*b*, lying on either side of the shape length line 104. FIG. 4 shows also that the convex portion may have a varying radius or radii. In other exemplary embodiments, the bonding shape 100 may include only a single convex portion (for example, to form a single arc shape rather than a multi-arc shape as shown in FIG. 4). It is believed that a bonding protrusion having bonding surface, fitting this description, repeated and arranged in a pattern, has beneficial effects on acceleration and deceleration of air through nonwoven fibers at and about the nip and brings advantages in the formation of apertures in the fully bonded nonwoven around the pins. Again, the bond shapes and sizes impressed on the nonwoven web will reflect and correspond with the bonding shapes and sizes on the roller.

The shape perimeter may have a convex portion on either side of the shape length line, forming symmetric shapes such as, for example, circles, ovals, etc. Such a shape may be found in Pattern 1 as referred to herein.

The shape perimeter may have a convex portion with or without a varying radius on both sides of shape length line 104, such that it has the overall contour of an airfoil with symmetrical camber, in cross section. In another alternative, the shape perimeter may have a convex portion on one side of shape length line 104 and a straight portion on or on the other side of shape length line 104, such that it has the overall contour of an airfoil/aircraft wing with asymmetrical camber, in cross section. In another alternative, the shape perimeter may have a convex portion on one side of shape length line 104 and a concave portion 103, disposed substantially opposite the concave portion, as reflected in FIG. 4, with such shape being found in Pattern 3 as referred to herein.

Without limitation, Table 1 describes bonding patterns might be used in exemplary embodiments of the present invention:

TABLE 1

Figure 6:
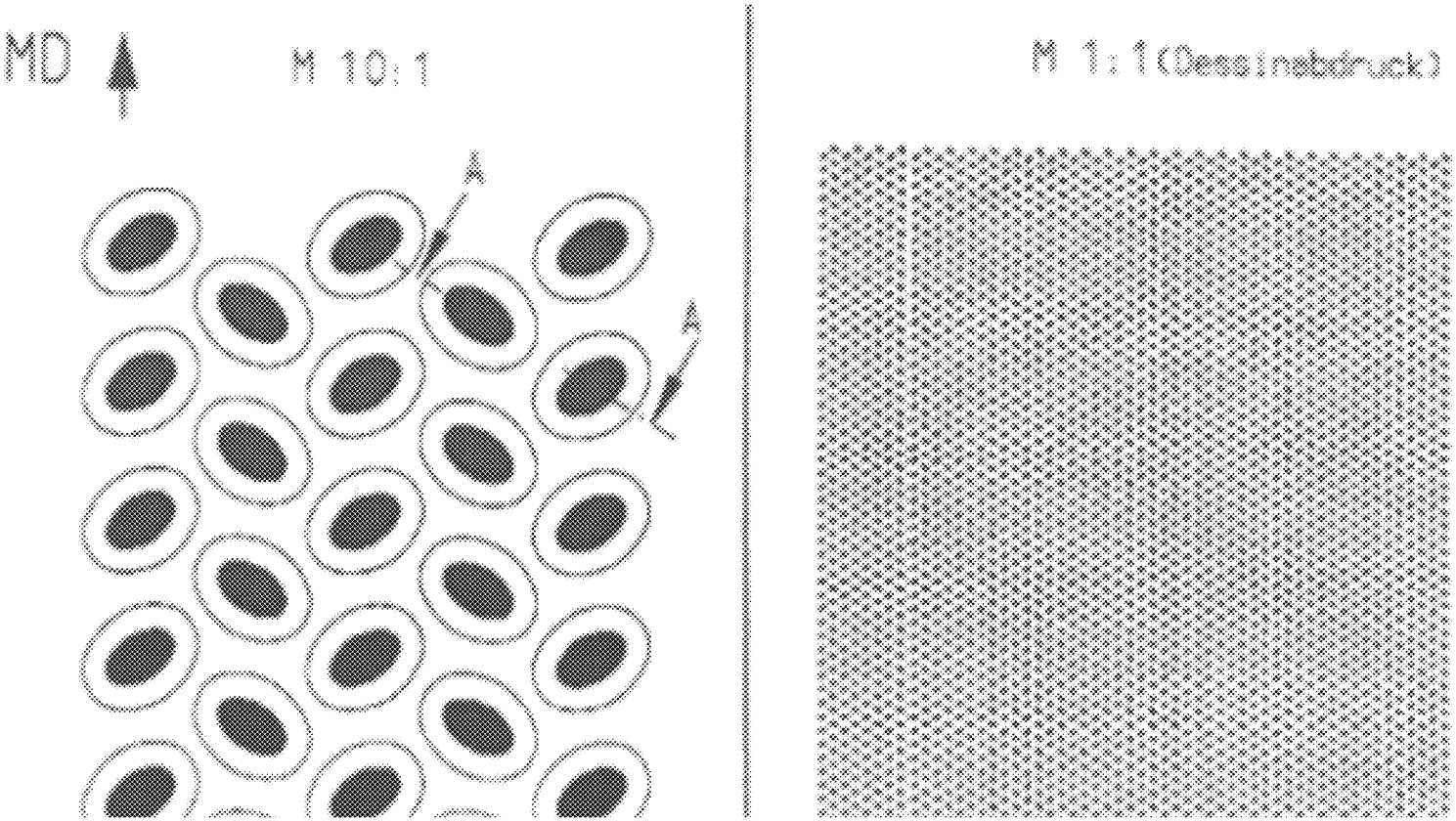
FIG. 6 shows a bonding pattern useable with a method of forming a patterned hydro-apertured nonwoven web according to an exemplary embodiment of the present invention.
Figure 7:
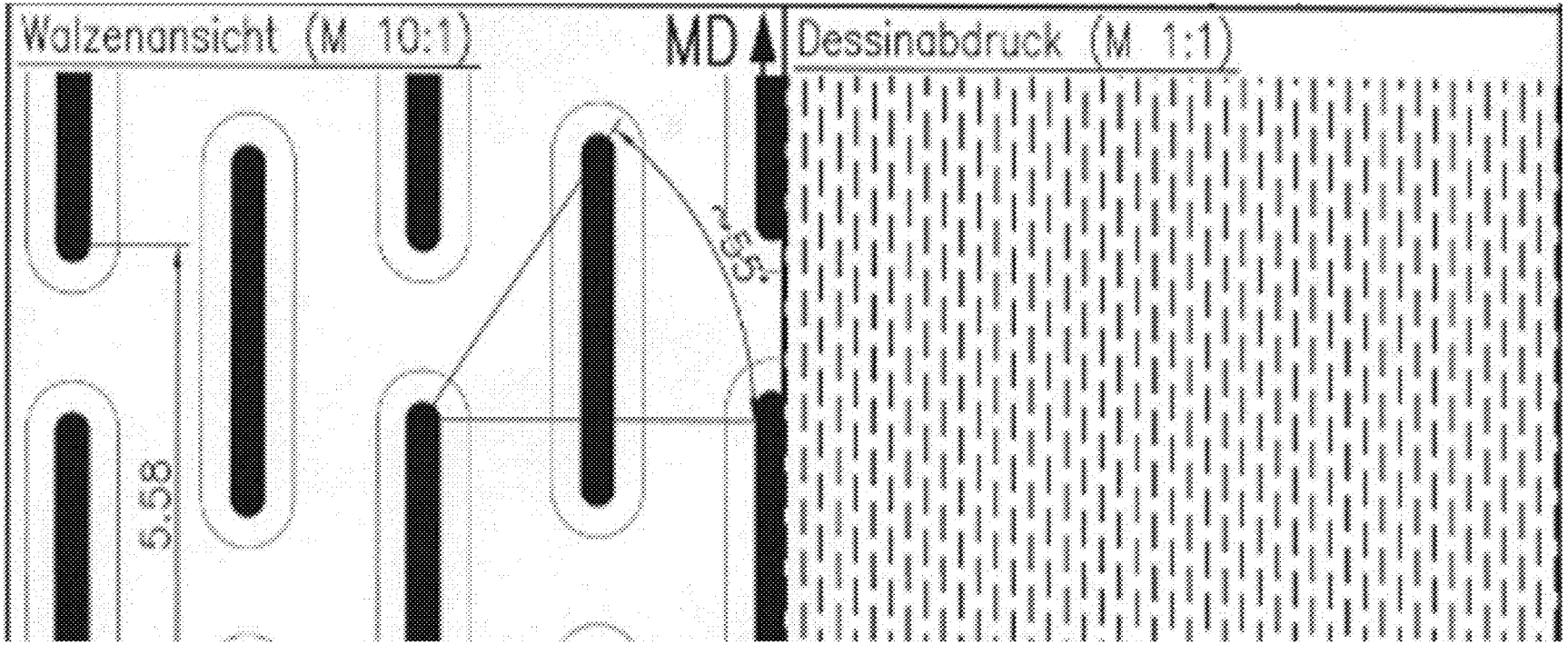
FIG. 7 shows a bonding pattern useable with a method of forming a patterned hydro-apertured nonwoven web according to an exemplary embodiment of the present invention.
Figure 8:
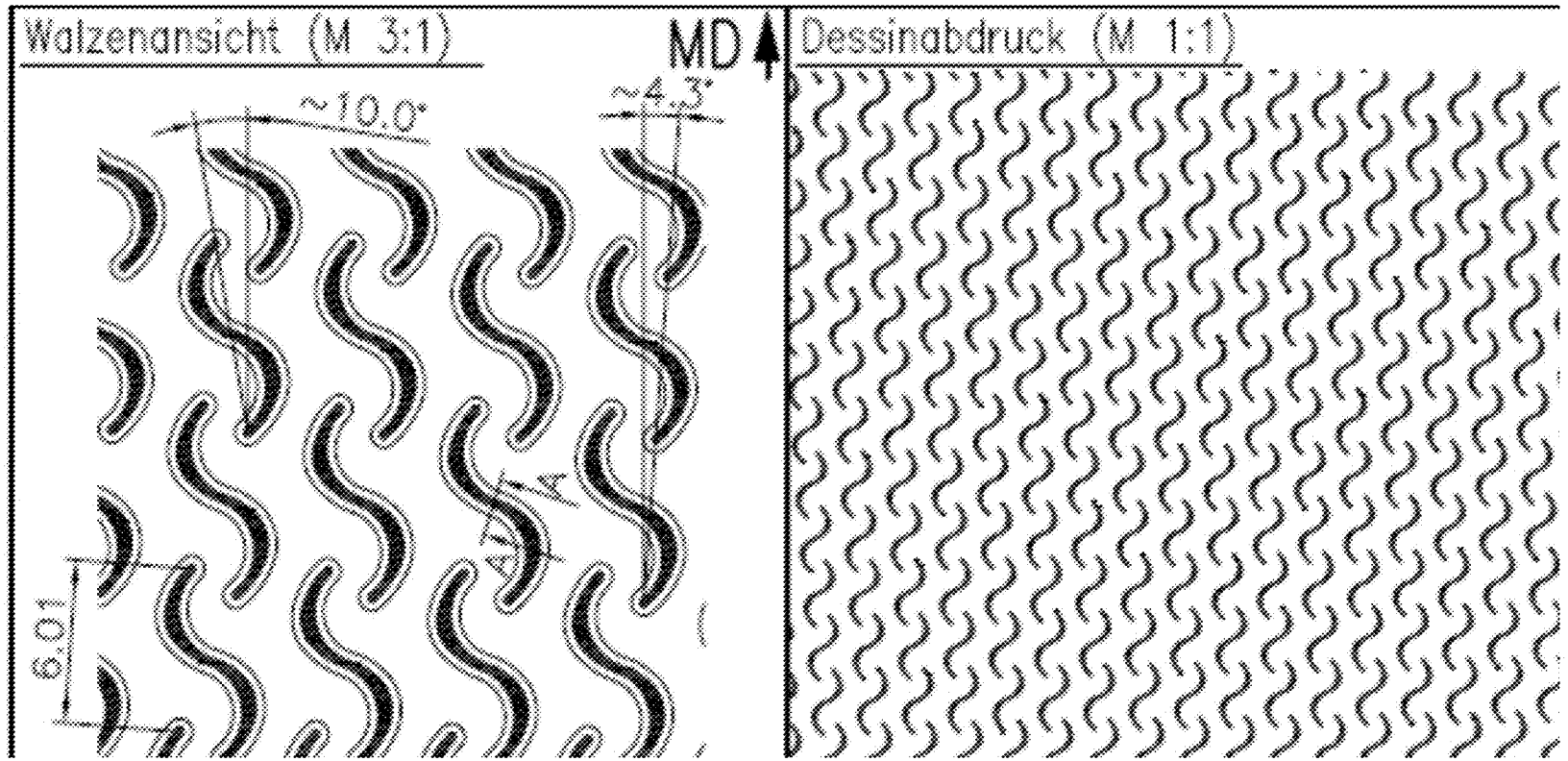
FIG. 8 shows a bonding pattern useable with a method of forming a patterned hydro-apertured nonwoven web according to an exemplary embodiment of the present invention.
Figure 9:
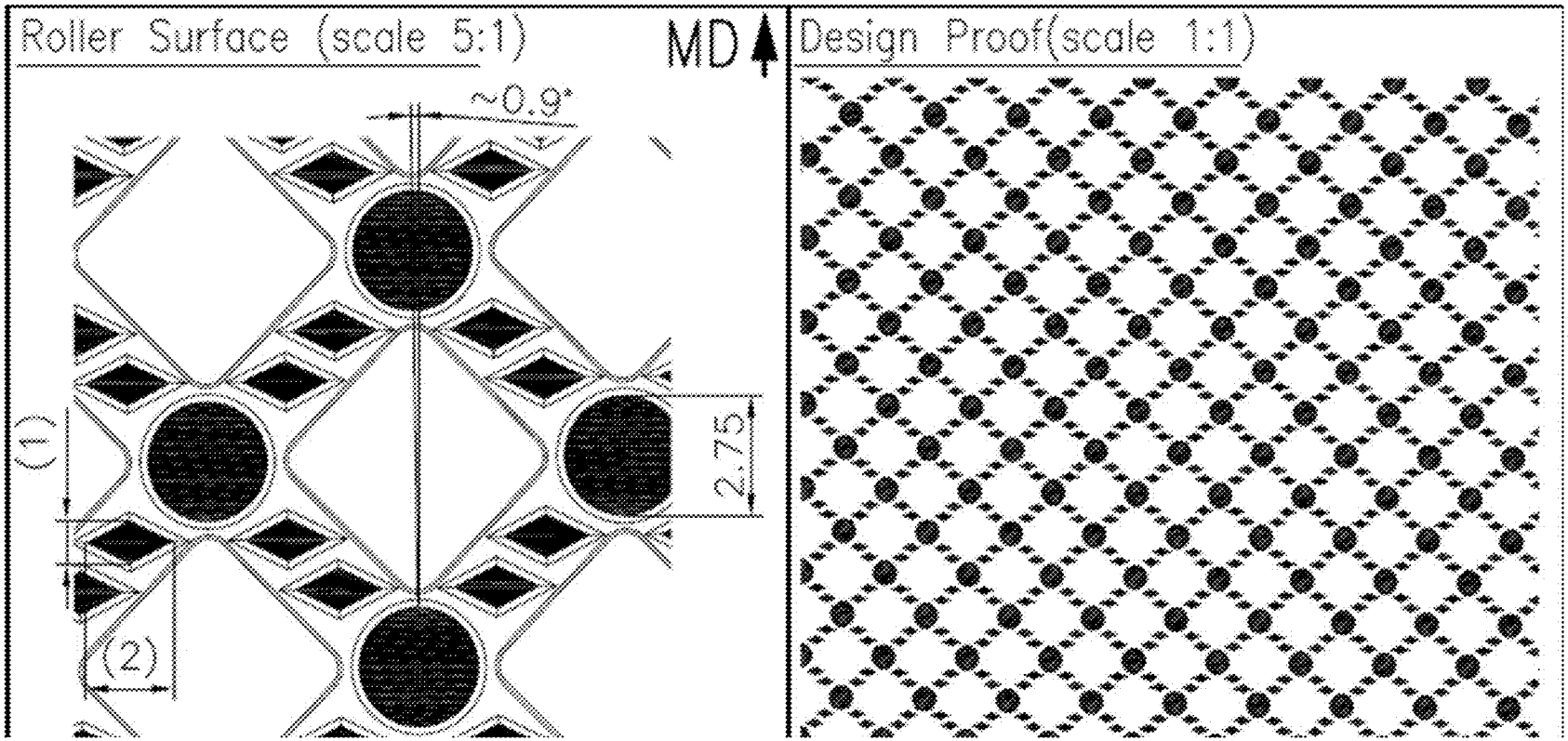
FIG. 9 shows a bonding pattern useable with a method of forming a patterned hydro-apertured nonwoven web according to an exemplary embodiment of the present invention.

| Name | Pattern 1 (oval) | Pattern 2 (lines) | Pattern 3 (S shape) | Pattern 4 (Large dot quilt) |
|---|---|---|---|---|
| Pattern type | Spaced bonding impressions | Spaced bonding impressions | Spaced bonding impressions | Quilted |
| Bonding area percentage | 18% | 14% | 13% | 22% |
| Bonding protrusions/cm$^2$ | 49.9 | 9 | 2.4 | 11.1 |
| Bonding impression size type | Small | Large | Large | Large + small |
| Angle $\alpha_T$ | 60° | 0° | 10° | 45° |
| L (mm) | 0.9 | 3.4 | 9.2 | Large: 2.8<br>Small: 2.0 |
| W (mm) | 0.5 | 0.4 | 3.0 | Large: 2.8<br>Small: 1.0 |
| L:W ratio | 1.8 | 8.5 | 3.1 | Large: 1<br>Small: 2 |
| Corresponding FIG. | FIG. 6 | FIG. 7 | FIG. 8 | FIG. 9 |

Bond impression patterns 1-3 disclosed herein are formed of bonding impressions each with a finite area. Such bond impressions are called "discontinuous". Bond impression pattern 4 has the smallest distance between adjacent bonding impressions 0.6 mm, so the bonding impressions are considered as one continuous bonding impression (quilted pattern).

From the presented examples it can be seen that the bonding impressions might have different sizes and so for a comparable bonding area the bonding pattern might look very different. For example, Pattern 1 has small bond points relatively close to each other (the number of bonding impressions per one square centimeter is approximately 50) while in contrast Pattern 3 provides large bonding impressions in a form of S-shaped lines relatively far from each other (the number of bonding impressions per one square centimeter is approximately 2.5). It should be noted that especially large bonding shapes or quilted patterns are preferably created by one large unitary bonding impression, but also can be made up of several smaller bonding impressions that form the overall bonding shape. For example, the individual S-shapes within Pattern 3 may be created from many smaller bond points or dots. For the purpose of the present disclosure, adjacent bonding impressions are considered as one bonding impression when the smallest distance between the adjacent bonding impressions is less than 0.7 mm, preferably less than 0.5 mm, even more preferably less than 0.4 mm, most preferably less than 0.3 mm.

In an exemplary embodiment, the precursor nonwoven web 7 has at least 20 bonding impressions per one square centimeter, preferably at least 30 bonding impressions per one square centimeter, more preferably at least 40 bonding impressions per one square centimeter, more preferably at least 50 bonding impressions per one square centimeter, even more preferably at least 60 bonding impressions per one square centimeter. For purposes of the present description, bonding impressions having values of bonding impressions per one square centimeter within these ranges are considered "small" size bonding impressions.

It might be unclear how to determine the number of bonding impressions per defined area for certain pattern designs. This situation may occur, for example, for patterns with several different types of bonding impression sizes or shapes, or for patterns with unbonded areas used as part of the design. In such cases, the bonding impressions are considered small when their total area (fused filaments area) is lower than 1 $mm^2$.

Figure 10:
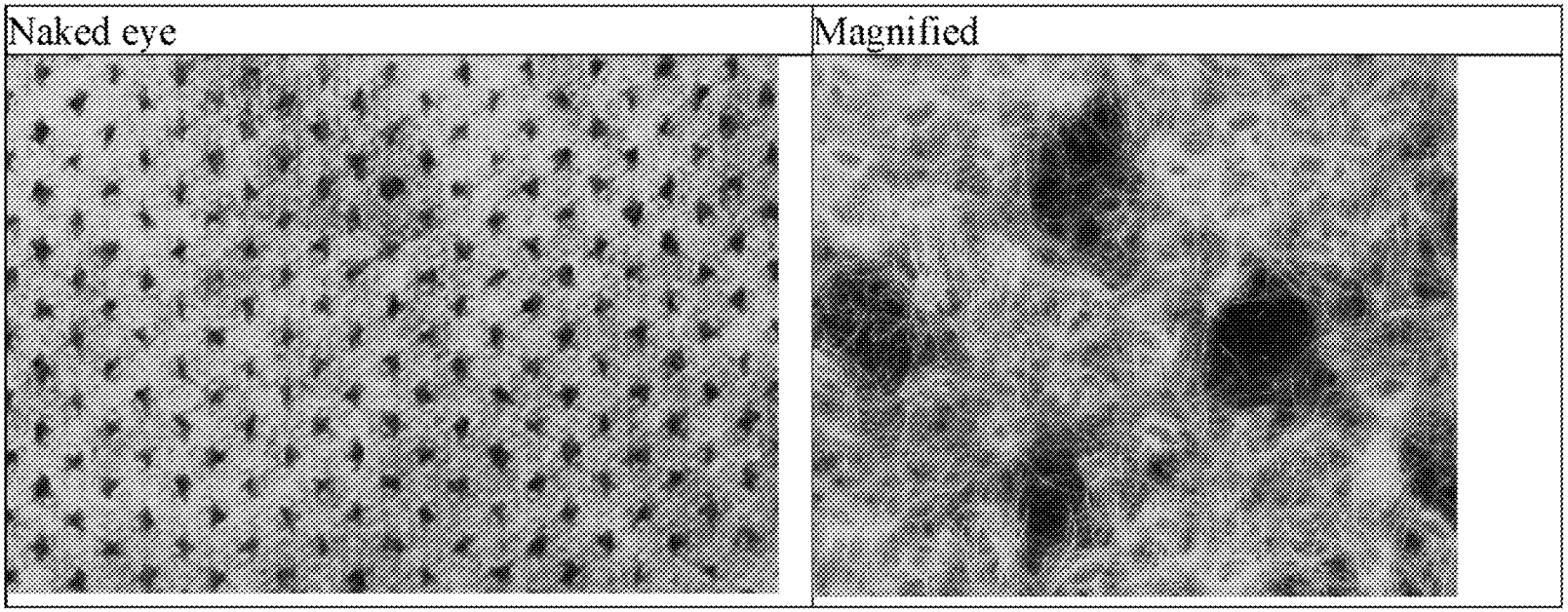
FIG. 10 are naked eye and magnified views of a patterned hydro-apertured nonwoven web according to an exemplary embodiment of the present invention.

Without being bound by theory, it is believed that the size and shape of the bonding impressions that make up the bonding pattern affects the final hydro-patterned fabric properties, such as, for example, aperture clarity, softness, stiffness and pattern visibility, to name a few. For example, in the case where the bonding impressions are small-sized and much smaller than the formed apertures, the bonding impressions are moved aside by the pins during the hydro-patterning process and therefore form a higher bonding impression density as compared to the precursor web, which in turn improves the stiffness of the apertured fabric product (see FIG. 10).

In accordance with another exemplary embodiment, the bonding impressions are large-sized and thus may be comparable in size to that of the apertures, and in exemplary embodiments may be larger in size as compared to the size of the apertures. Such relatively large bonding impressions may provide the precursor web with a relatively small bonding impression density, such as, for example, less than 20 bonding impressions per one square centimeter, preferably less than 15 bonding impressions per one square centimeter, more preferably less than 10 bonding impressions per one square centimeter, and even more preferably less than 5 bonding impressions per one square centimeter. For purposes of the present description, bonding impressions having values of bonding impressions per one square centimeter within these ranges are considered "large" size bonding impressions.

Without being bound by theory, it is believed that large bonding impressions on the precursor web 7 undergoing the above described hydraulic aperturing process might result in a fabric with a pattern of high clarity apertures where the bonding impressions are visible to the naked eye, thereby providing the fabric with a desirable and highly visible design of both apertures and bonding impressions.

Without being bound by theory it is believed that bonding impression shape and orientation in the MD/CD direction also influences the clarity of apertures and the integrity of the bonding pattern in the hydro-patterned fabric. For example, certain bonding pattern shapes might negatively interact with the pins during the hydro-patterning process, thereby resulting in decreased aperture clarity and a compromised bond pattern in the fabric. In contrast, bonding patterns with spaced bonding impressions, arranged in rows and/or columns, and/or with certain shapes, might avoid interference with the pin pattern, resulting in high clarity apertures with the bonding impressions visible and intact between the apertures.

Figure 11:
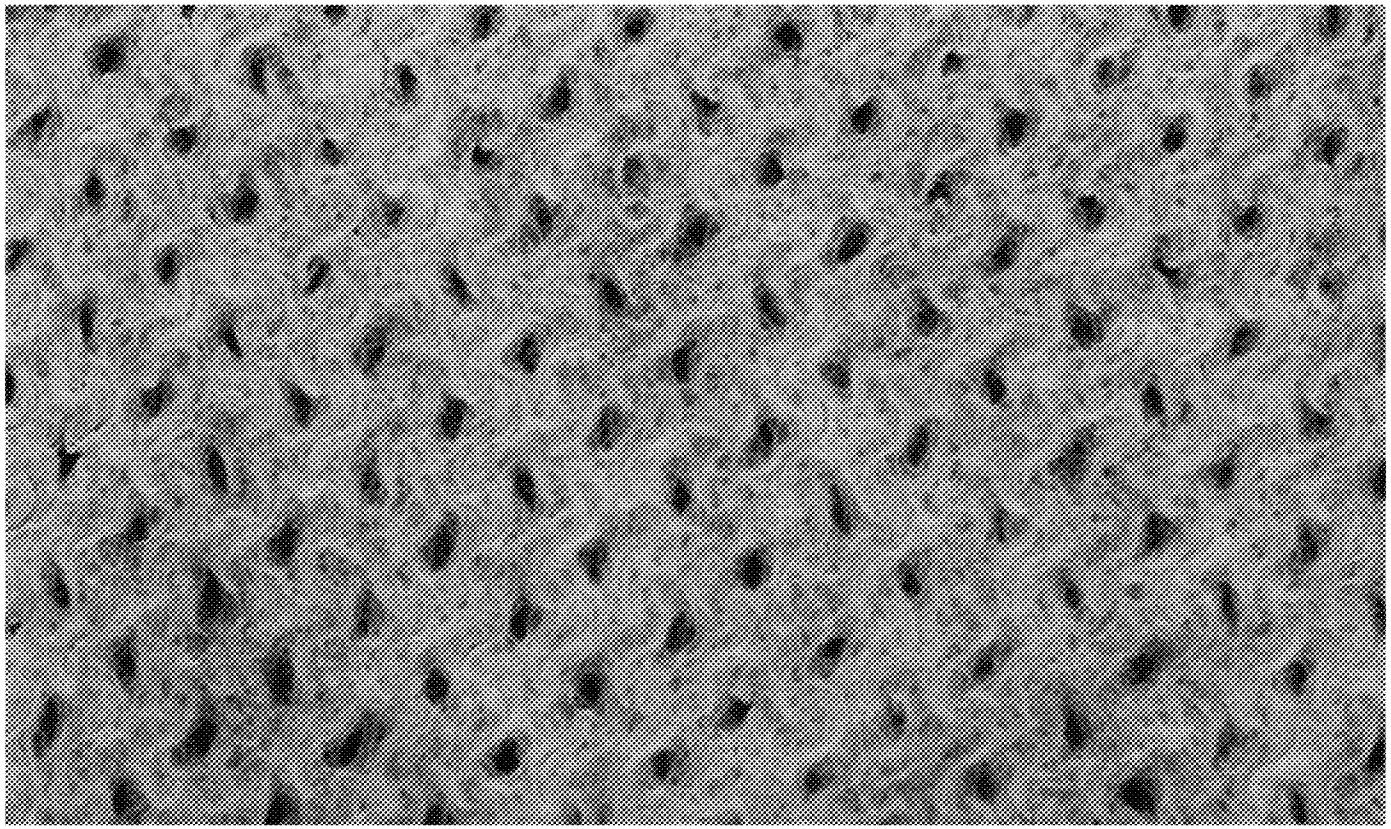
FIG. 11 is a photograph showing a planar view of a patterned hydro-apertured nonwoven web according to an exemplary embodiment of the present invention.

Without being bound by theory, it is believed that during the hydro-patterning process, the large bonding impressions behave differentially than small ones. For example, the large impressions are not as easily moved aside during the hydro-patterning process, so that the bonding impression density is not significantly altered, if at all, as compared to that of the precursor web. For example, as shown in FIG. 11, the S-shaped bonding impressions of Pattern 3 provides space for the pins arranged in a regular "square" pin-pattern to form apertures, and the shape, tilt and length to width ratio of the impressions provide enhanced aperture clarity in combination with enhanced mechanical properties, such as, for example, softness. As also seen in FIG. 11, the S-shape bonding impressions of Pattern 3 are visible to the naked eye in the fabric, due to the bonding impressions' ability to "flow" around the pins during the hydro-patterning process.

Figure 12:
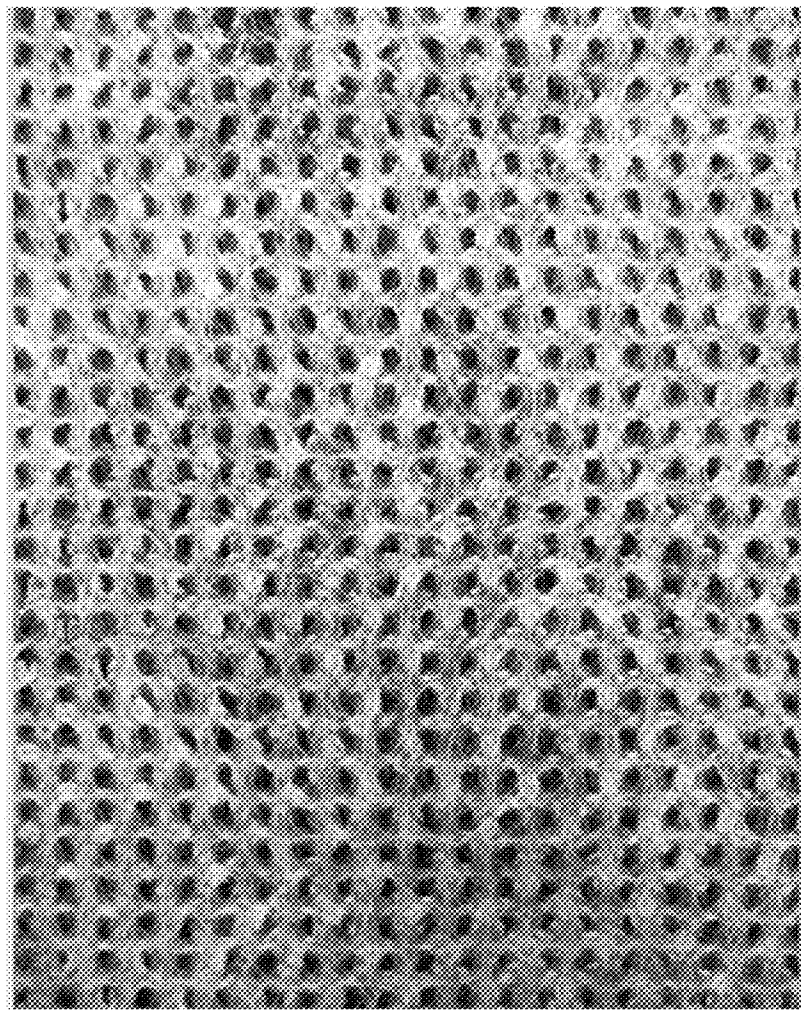
FIG. 12 is a photograph showing a planar view of a patterned hydro-apertured nonwoven web according to an exemplary embodiment of the present invention.

As another example, FIG. 12 shows the bonding impressions of Pattern 4 (large dot quilt) being visible among the apertures, although not as evident as compared to Pattern 3. Specifically, in this example, the precursor web was fully bonded using Pattern 4 made up of large circles and small diamonds very close together. The small diamonds act as small bonding impressions and are not clear to the naked eye after the hydro-patterning process. In contrast, the large circles of Pattern 4 remain visible, thereby forming in combination with the apertures a different visual effect as compared to the original thermo-bonded pattern on the precursor.

In an exemplary embodiment the precursor nonwoven web 7 provides bonding impressions with differing sizes. For example, WO2017190717 discloses a bonding pattern made up of primary and auxiliary bonding impressions. Under such circumstances, density of large and small bonding impressions should be judged separately. For example, small (or auxiliary) bonding impressions density should be estimated from the area without taking into account the large (or primary) bonding impressions.

In an exemplary embodiment, the precursor nonwoven web may have a stiffness expressed by Handle-O-Meter Test method (HOM). During the test the fabric is forced to bend into a nip having a relatively small scale (6.2 mm width, 8.0 mm deep) that is believed to be analogous to a filament bending around the pin. If the bending force is too small, the filaments act in an elastic manner and thus tend to come back to their original position after hydro-patterning, which in turn results in at least partial closing of the apertures after hydro-patterning. If the bending force is high, the filaments might tend to break and free ends of the filaments might interfere with the apertures, thereby decreasing aperture clarity level. Further, when the bending force is too high, the fabric resistance might not allow the pins to enter the structure and prevent formation of apertures.

In accordance with an exemplary embodiment, the precursor nonwoven web 7 has an MD HOM value of at least 5 g.

In accordance with an exemplary embodiment, the precursor nonwoven web 7 has an MD HOM value of maximum 30 g, preferably of maximum 25 g.

In exemplary embodiment, the precursor nonwoven web 7 has a CD HOM value of at least 2 g.

In accordance with an exemplary embodiment, the precursor nonwoven web 7 has CD HOM value of maximum 20 g, preferably of maximum 15 g.

In accordance with an exemplary embodiment, the apertured hydro-patterned nonwoven web 9 has a basis weight of 10 gsm to 45 gsm, preferably 20 gsm to 35 gsm.

In accordance with an exemplary embodiment, the apertured hydro-patterned nonwoven web 9 has a caliper of at least 12 microns/gsm of fabric.

In accordance with an exemplary embodiment, the apertured hydro-patterned nonwoven web 9 has a MD tensile strength of at least 4 N/cm.

In accordance with an exemplary embodiment, the apertured hydro-patterned nonwoven web 9 has a CD tensile strength of at least 2 N/cm.

Figure 13:
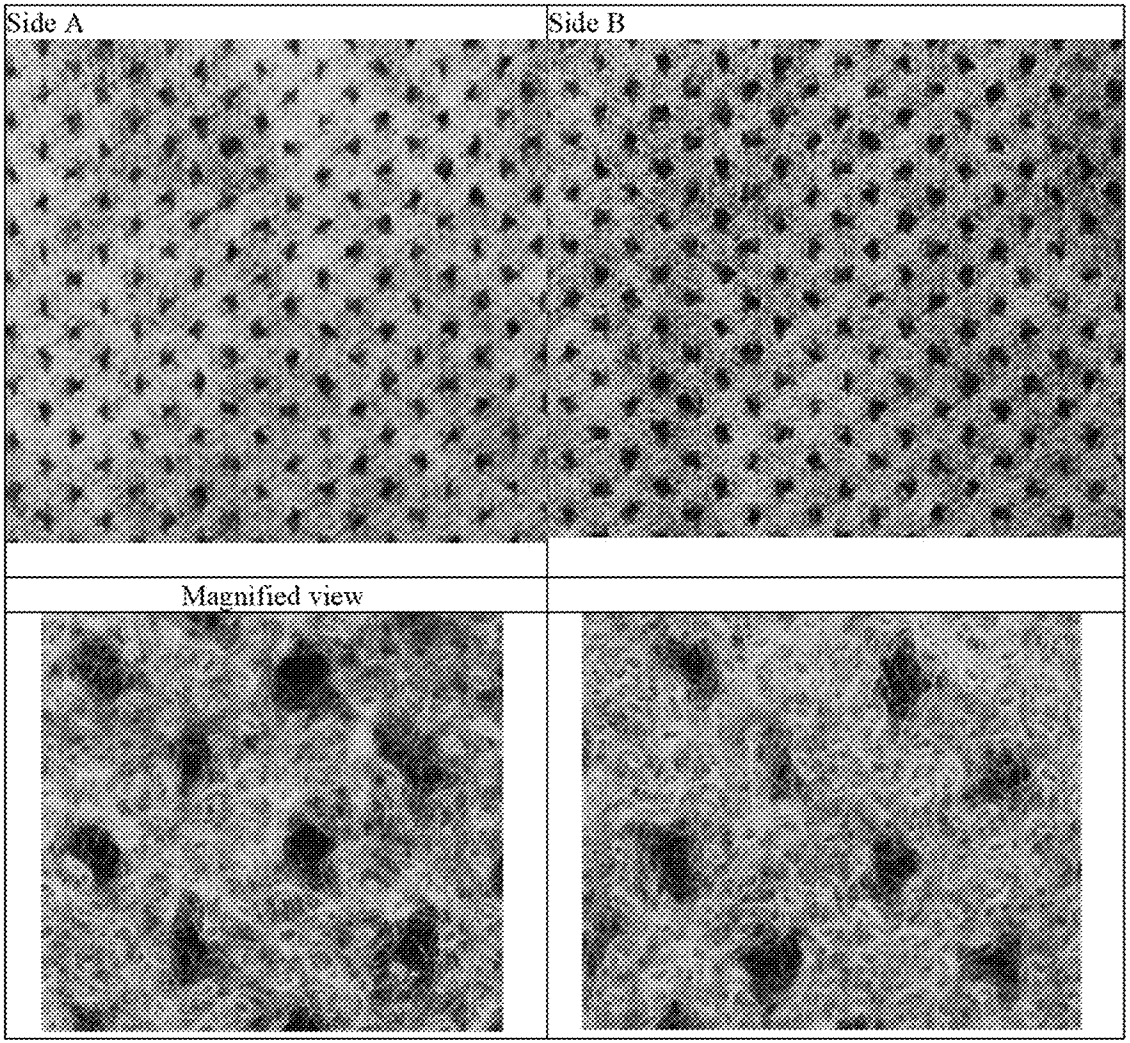
FIG. 13 are naked eye and magnified views of both sides of a patterned hydro-apertured nonwoven web according to an exemplary embodiment of the present invention.
Figure 14:
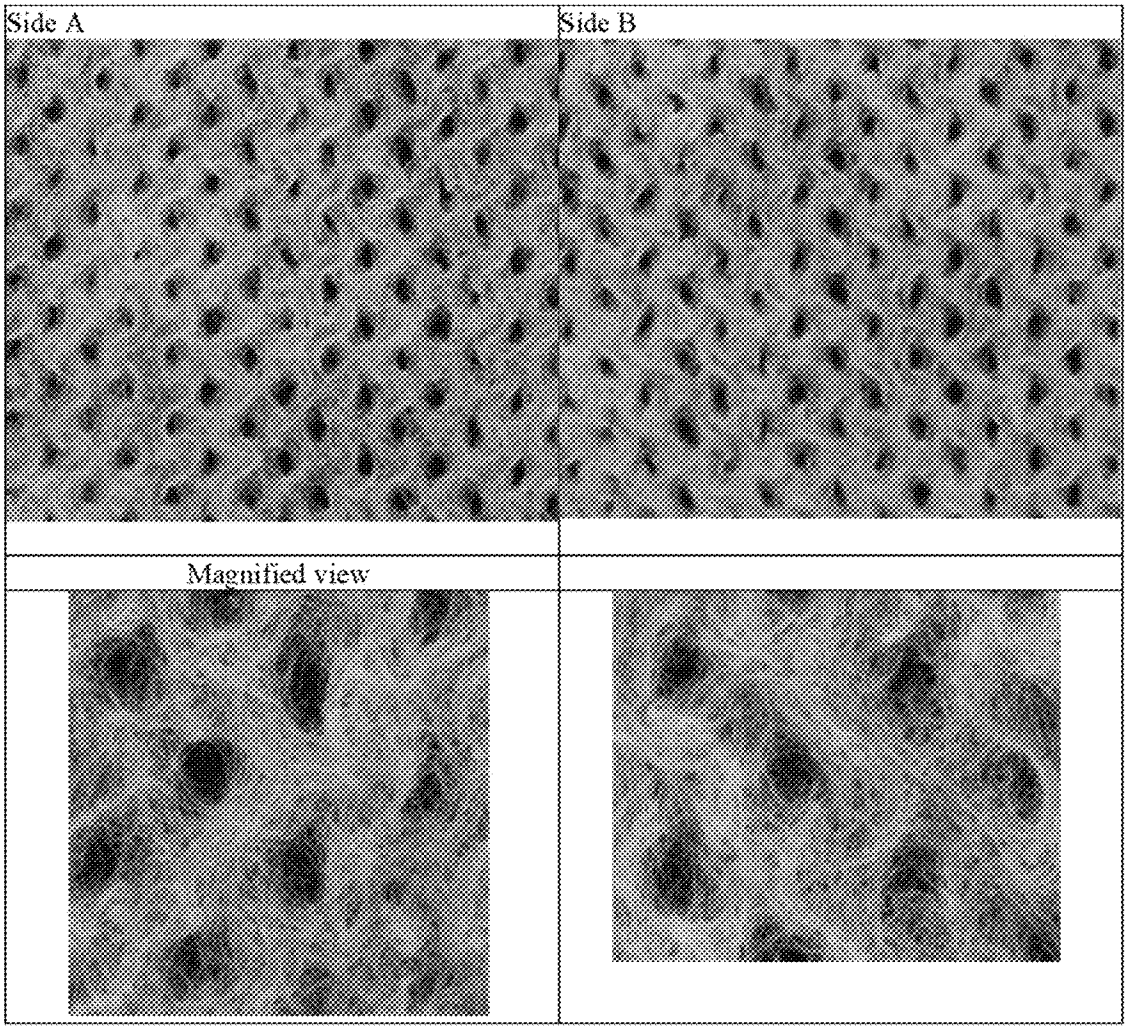
FIG. 14 are naked eye and magnified views of both sides of a patterned hydro-apertured nonwoven web according to an exemplary embodiment of the present invention.

In accordance with an exemplary embodiment, the apertured hydro-patterned nonwoven web 9 does not exhibit two-sidedness. This can be seen in FIGS. 13 and 14 showing naked eye and magnified photos of fabric according to exemplary embodiments of the present invention. The apertured hydro-patterned nonwoven web 9 does not exhibit two sidedness at least in terms of physical and material characteristics.

Figure 15:
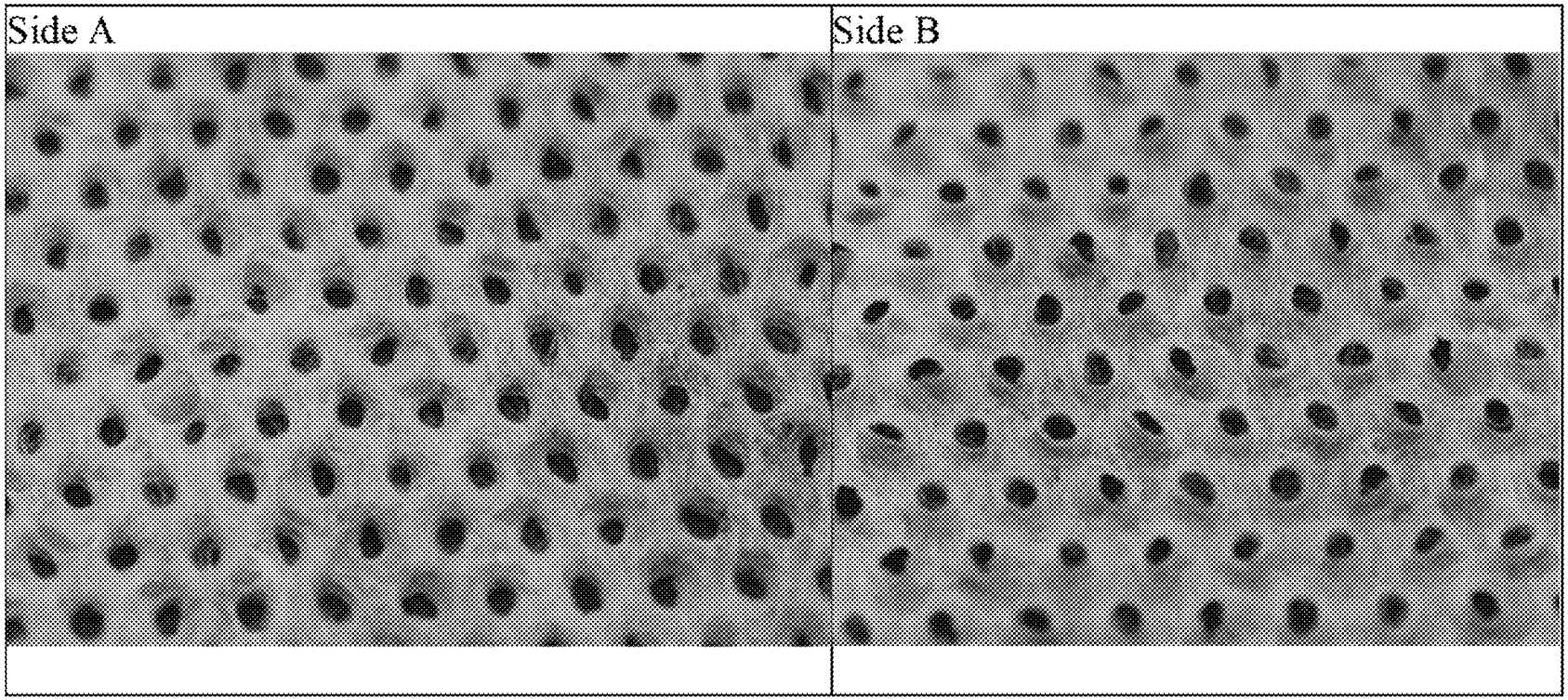
FIG. 15 are magnified views of both sides of a conventional apertured nonwoven web.

In contrast, most conventional aperturing techniques result in formation of three-dimensional or cone-like apertures, which in turn results in the final web product exhibiting two-sidedness. For example, conventional technologies using heat with needles/pins typically provide apertures with less desirable tactile feel due to the side at which the aperturing was initiated being clearly evident (see FIG. 15). The two-sidedness associated with conventional apertured web products may interfere with the performance of such products due to one side of the fabric exhibiting undesirable characteristics.

The apertured hydro-pattern nonwoven web 9 according to exemplary embodiments of the present invention exhibits relatively high levels of softness. This is at least partially due to the lack of sharp edges around the apertures. This is in contrast with most conventional technologies using heat to provide openings in fabric. It should be noted that softness itself is a very general term involving many various perceptions, some which might be expressed by measurements such as Handle-O-Meter, Cantilever test, compressibility, thickness, coefficient of friction and/or many other methodologies. Each test provides just partial limited information about softness and might be suitable for some applications or some ranges of basis weight, some polymer compositions, etc.

The nonwoven web 9 may be incorporated into a nonwoven laminate. The nonwoven laminate may include additional layers of continuous fibers such as spunbond fibers and meltblown fibers and may include composite nonwovens such as spunbond-meltblown-spunbond laminates. The nonwoven laminate may also include short fibers such as staple fibers or may include pulp fibers. These short fibers may be in the form of a consolidated web such as carded web or tissue sheet or may be initially unconsolidated. The nonwoven laminate may also include superabsorbent material, either in particulate form or in a fiberized form. The laminate may be formed through conventional means, including but not limited to thermal bonding, ultrasonic bonding, chemical bonding, adhesive bonding and/or hydroentanglement. In accordance with an embodiment of the invention, web 9 may form a nonwoven laminate resulting from the one or more processes described above for use as a topsheet, an absorbent core, or a backsheet of an absorbent article.

The following Examples and Comparative Examples illustrates advantages of the present invention.

Comparative Example 1 (Precursor Web to Example 1)

A 25 gsm spunmelt type nonwoven batt was produced online in a continuous process from a mixture of polypropylene (type 3155E5 from Exxon) with color additive (SCC 91056 from Standridge Color Corporation) and soft enhancing additive based on erucamide (CESA-slip PP 42161 from Avient), where monocomponent polypropylene filaments with a fiber diameter of 13-25 μm were produced and subsequently collected on a moving belt. The batt was produced on REICOFIL 3.1 technology (Reifenhauser Reicofil GmbH & Co. KG, Troisdorf, Germany) from four spunbond beams. The nonwoven batt was fully bonded by a pair of heated rollers, where one roller has raised Pattern 3 (FIG. 8). The temperature of the calender rollers (smooth roller/patterned roller) was 160° C./162° C. and the bonding pressure was 75 N/mm. The resulting nonwoven web had material properties as shown in Table 2.

Example 1

The same nonwoven web was formed as described in Comparative Example 1, but with an additional step of hydro-patterning. The hydro-patterning was achieved with two drums, with the last drum in the line providing the web with apertures. The first drum had a wire mesh screen and two injectors at the drum, each applying a water pressure as shown in table 2. The first drum was used to hydrotreat the web before aperturing at the second drum. Each injector had two rows of holes, with the holes within each row spaced a distance of 0.6 mm from one another. The second drum had a screen with an A1 pattern of pins (pins spaced a distance of 4.5 mm from one another) as described herein. Three injectors applying water pressure as shown in table 2 were used to hydro-pattern the web with a pattern of apertures by forcing the web down onto the pins. The three injectors at the second drum each had two strips of holes, with the holes within each strip spaced a distance of 0.6 mm from one another. The aperturing process of Example 1 is summarized in Table 3. The resulting nonwoven web had material properties as shown in Table 2.

Comparative Example 2 (Precursor Web to Example 2)

A 25 gsm spunmelt type nonwoven batt was produced online in a continuous process from a mixture of polypropylene (Mosten NB425 from Unipetrol) and copolymer (Vistamaxx 6202 from Exxon) in the weight ratio 75:15, color additive (SCC 91056 from Standridge Color Corporation) and soft enhancing additive based on erucamide (CESA-slip PP 42161 from Avient), where monocomponent polypropylene filaments with a fiber diameter of 13-25 μm were produced and subsequently collected on a moving belt. The batt was produced on REICOFIL 3.1 technology from four beams. The nonwoven batt was fully bonded by a pair of heated rollers, where one roller had raised Pattern 3 (FIG. 8). The temperature of the calender rollers (smooth roller/patterned roller) was 150° C./155° C. and the bonding pressure was 75 N/mm. The resulting nonwoven web had material properties as shown in Table 2.

Example 2

The same nonwoven web was formed as described in Comparative Example 2, but with an additional step of hydro-patterning. The hydro-patterning was achieved with two drums, with the last drum in the line providing the web with apertures. The first drum had a wire mesh screen and one injector at the drum applying a water pressure of 200 bar to hydrotreat the web before aperturing at the second drum. The one injector at the first drum had two rows of holes, with the holes within each strip spaced a distance of 1.2 mm from one another. The second drum had a screen with an A1 pattern of pins (pins spaced a distance of 4.5 mm from one another) as described herein. Three injectors applying water pressure of 220 bar, 220 bar and 250 bar, respectively, were used to hydro-pattern the web with a pattern of apertures by forcing the web down onto the pins. The three injectors at the second drum each had two strips of holes, with the holes within each strip spaced a distance of 0.6 mm from one another. The aperturing process of Example 2 is summarized in Table 3. The resulting nonwoven web had material properties as shown in Table 2.

Comparative Example 3 (Precursor Web to Example 3)

A 25 gsm spunmelt type nonwoven batt was produced online in a continuous process from a mixture of polypropylene (type 3155E5 from Exxon) with color additive (SCC 91056 from Standridge Color Corporation), where monocomponent polypropylene filaments with a fiber diameter of 13-25 μm was produced and subsequently collected on a moving belt. The batt was produced on REICOFIL 3.1 technology from four spunbond beams. The nonwoven batt was fully bonded by a pair of heated rollers, where one roller had raised Pattern 2 (FIG. 7). The temperature of the calender rollers (smooth roller/patterned roller) was 160° C./162° C. and the bonding pressure was 75 N/mm. The resulting nonwoven web had material properties as shown in Table 2.

Example 3

The same nonwoven web was formed as described in Comparative Example 3, but with an additional step of hydro-patterning. The hydro-patterning was achieved with two drums, with the last drum in the line providing the web with apertures. The first drum had a wire mesh screen and one injector at the drum applying a water pressure of 200 bar to hydrotreat the web before aperturing at the second drum. The one injector at the first drum had two strips of holes, with the holes within each row spaced a distance of 1.2 mm from one another. The second drum had a screen with an A1 pattern of pins (pins spaced a distance of 4.5 mm from one another) as described herein. Three injectors applying water pressure of 220 bar, 220 bar and 250 bar, respectively, were used to hydro-pattern the web with a pattern of apertures by forcing the web down onto the pins. The three injectors at the second drum each had two strips of holes, with the holes within each strip spaced a distance of 0.6 mm from one another. The aperturing process of Example 3 is summarized in Table 3. The resulting nonwoven web had material properties as shown in Table 2.

Comparative Example 4 (Precursor Web to Example 4)

A 25 gsm spunmelt type nonwoven batt was produced online in a continuous process from a mixture of polypropylene (Mosten NB425 from Unipetrol) and copolymer (Vistamaxx 6102 from Exxon) in the weight ratio 75:15, color additive (SCC 91056 from Standridge Color Corporation) and soft enhancing additive based on erucamide (CESA-slip PP 42161 from Avient), where monocomponent polypropylene filaments with a fibre diameter of 13-25 μm were produced and subsequently collected on a moving belt. The batt was produced on REICOFIL 3.1 technology from for beams. The nonwoven batt was fully bonded by a pair of heated rollers, where one roller had raised Pattern 2 (FIG. 7). The temperature of the calender rollers (smooth roller/patterned roller) was 150° C./155° C. and the pressure was 75 N/mm. The resulting nonwoven web had material properties as shown in Table 2.

Example 4

The same nonwoven web was formed as described in Comparative Example 4, but with an additional step of hydro-patterning. The hydro-patterning was achieved with two drums, with the last drum in the line providing the web with apertures. The first drum had a wire mesh screen and one injector at the drum applying a water pressure of 200 bar to hydrotreat the web before aperturing at the second drum. The one injector at the first drum had two strips of holes, with the holes within each strip spaced a distance of 1.2 mm from one another. The second drum had a screen with an A1 pattern of pins (pins spaced a distance of 4.5 mm from one another) as described herein. Three injectors applying water pressure of 220 bar, 220 bar and 250 bar, respectively, were used to hydro-pattern the web with a pattern of apertures by forcing the web down onto the pins. The three injectors at the second drum each had two strips of holes, with the holes within each strip spaced a distance of 0.6 mm from one another. The aperturing process of Example 4 is summarized in Table 3. The resulting nonwoven web had material properties as shown in Table 2.

Comparative Example 5 (Precursor Web to Example 5)

A 25 gsm spunmelt type nonwoven batt was produced online in a continuous process from a mixture of polypropylene (type 3155E5 from Exxon) with color additive (SCC 91056 from Standridge Color Corporation), where monocomponent polypropylene filaments with a fiber diameter of 13-25 μm were produced and subsequently collected on a moving belt. The batt was produced on REICOFIL 3.1 technology from four spunbond beams. The nonwoven batt was fully bonded by a pair of heated rollers, where one roller had raised Pattern 1 (FIG. 6). The temperature of the calender rollers (smooth roller/patterned roller) was 160° C./162° C. and the bonding pressure was 75 N/mm. The resulting nonwoven web had material properties as shown in Table 2.

Example 5

The same nonwoven web was formed as described in Comparative Example 5, but with an additional step of hydro-patterning. The hydro-patterning was achieved with two drums, with the last drum in the line providing the web with apertures. The first drum had a wire mesh screen and one injector at the drum applying a water pressure of 200 bar to hydrotreat the web before aperturing at the second drum. The one injector at the first drum had two strips of holes, with the holes within each strip spaced a distance of 1.2 mm from one another. The second drum had a screen with an A1 pattern of pins (pins spaced a distance of 4.5 mm from one another) as described herein. Three injectors applying water pressure of 220 bar, 220 bar and 250 bar, respectively, were used to hydro-pattern the web with a pattern of apertures by forcing the web down onto the pins. The three injectors at the second drum each had two strips of holes, with the holes within each strip spaced a distance of 0.6 mm from one another. The aperturing process of Example 5 is summarized in Table 3. The resulting nonwoven web had material properties as shown in Table 2.

Comparative Example 6 (Precursor Web to Example 6)

A 25 gsm spunmelt type nonwoven batt was produced online in a continuous process from a mixture of polypropylene (Mosten NB425 from Unipetrol) and copolymer (Vistamaxx 6102 from Exxon) in the weight ratio 75:15, color additive (SCC 91056 from Standridge Color Corporation) and soft enhancing additive based on erucamide (CESA-slip PP 42161 from Avient), where monocomponent polypropylene filaments with a fibre diameter of 13-25 μm were produced and subsequently collected on a moving belt. The batt was produced on REICOFIL 3.1 technology from four beams. The nonwoven batt was fully bonded by a pair of heated rollers, where one roller had raised Pattern 1 (FIG. 6). The temperature of the calender rollers (smooth roller/patterned roller) was 150° C./155° C. and the bonding pressure was 75 N/mm. The resulting nonwoven web had material properties as shown in Table 2.

Example 6

The same nonwoven web was formed as described in Comparative Example 6, but with an additional step of hydro-patterning. The hydro-patterning was achieved with two drums, with the last drum in the line providing the web with apertures. The first drum had a wire mesh screen and one injector at the drum applying a water pressure of 200 bar to hydrotreat the web before aperturing at the second drum. The one injector at the first drum had two rows of holes, with the holes within each strip spaced a distance of 1.2 mm from one another. The second drum had a screen with an A1 pattern of pins (pins spaced a distance of 4.5 mm from one another) as described herein. Three injectors applying water pressure of 220 bar, 220 bar and 250 bar, respectively, were used to hydro-pattern the web with a pattern of apertures by forcing the web down onto the pins. The three injectors at the second drum each had two strips of holes, with the holes within each strip spaced a distance of 0.6 mm from one another. The aperturing process of Example 6 is summarized in Table 3. The resulting nonwoven web had material properties as shown in Table 2.

TABLE 2

| | COMPARATIVE EXAMPLE (precursor web) | | | | | | EXAMPLE | | | | | |
|---|---|---|---|---|---|---|---|---|---|---|---|---|
| | 1 | 2 | 3 | 4 | 5 | 6 | 1 | 2 | 3 | 4 | 5 | 6 |
| MDT, N/cm | 9.2 | 9.8 | 7.9 | 9.0 | 13.4 | 9.0 | 6.9 | 7.5 | 4.3 | 2.3 | 6.4 | 4.3 |
| MDE, Peak, % | 55 | 77 | 41 | 67 | 74 | 54 | 67 | 69 | 52 | 75 | 54 | 46 |
| CDT, N/cm | 5.3 | 5.5 | 4.9 | 3.9 | 6.9 | 4.9 | 3.2 | 4.2 | 1.5 | 6.3 | 2.9 | 2.5 |
| CDE, Peak, % | 71 | 89 | 67 | 79 | 87 | 61 | 68 | 85 | 65 | 63 | 65 | 65 |
| MD HOM, g | 6.3 | 4.5 | 5.8 | 4.6 | 8.0 | 5.1 | 6.2 | 5.7 | | 5.5 | 8.6 | 3.9 |
| CD HOM, g | 2.7 | 1.8 | 2.0 | 1.2 | 3.4 | 2.4 | 3.6 | 3.1 | | 2.3 | 5.3 | 2.4 |
| Avg HOM, g | 4.5 | 3.1 | 3.9 | 2.9 | 5.7 | 3.7 | 4.9 | 4.4 | | 3.9 | 7.0 | 3.2 |
| Thickness, mm | 0.20 | 0.17 | 0.21 | 0.18 | 0.18 | 0.17 | 0.51 | 0.37 | 0.47 | 0.39 | 0.46 | 0.37 |
| Kinetic CoF side A | 0.35 | 0.38 | 0.35 | 0.38 | 0.32 | 0.37 | 0.70 | 0.49 | | 0.45 | 0.62 | 0.47 |
| Kinetic CoF side B | 0.35 | 0.38 | 0.35 | 0.38 | 0.32 | 0.37 | 0.70 | 0.49 | | 0.45 | 0.62 | 0.47 |
| Abrasion data A side | 5 | 5 | 2 | 5 | 5 | 5 | | 5 | 2.5 | 5 | 5 | 5 |
| Abrasion data B side | 5 | 5 | 2 | 5 | 5 | 5 | | 5 | 2.5 | 5 | 5 | 5 |
| Visual Clarity | n/a | n/a | n/a | n/a | n/a | n/a | 3 | 3 | 4 | 3 | 4 | 3 |

TABLE 3

| | PATTERN of precursor web | LINE SPEED (mpm) | HYDRO-PATTERNING DRUM 1 STRIP | DRUM 1 INJ1 (bar) | DRUM 2 STRIP | DRUM 2 Pin pattern | DRUM 2 INJ1 (bar) | DRUM 2 INJ2 (bar) | DRUM 2 INJ3 (bar) | Energy flux (kWh/kg) |
|---|---|---|---|---|---|---|---|---|---|---|
| EXAMPLE 1 | 3 (S) | 200 | 2j12 | 200 | 2j6 | A1 | 220 | 220 | 250 | 0.6 |
| EXAMPLE 2 | 3 (S) | 200 | 2j12 | 200 | 2j6 | A1 | 220 | 220 | 250 | 0.6 |
| EXAMPLE 3 | 2 (lines) | 200 | 2j12 | 200 | 2j6 | A1 | 220 | 220 | 250 | 0.6 |
| EXAMPLE 4 | 2 (lines) | 200 | 2j12 | 200 | 2j6 | A1 | 220 | 220 | 250 | 0.6 |
| EXAMPLE 5 | 1 (Oval) | 200 | 2j12 | 200 | 2j6 | A1 | 220 | 220 | 250 | 0.6 |
| EXAMPLE 6 | 1 (Oval) | 200 | 2j12 | 200 | 2j6 | A1 | 220 | 220 | 250 | 0.6 |

Comparative Example 7 (Precursor Web to Example 7)

A 35 gsm spunmelt type nonwoven batt was produced online in a continuous process from a mixture of polypropylene (type 3155E5 from Exxon) with color additive (SCC 91056 from Standridge Color Corporation), where monocomponent polypropylene filaments with a fiber diameter of 13-25 μm were produced and subsequently collected on a moving belt. The batt was produced on REICOFIL 5 technology from three spunbond beams. The nonwoven batt was fully bonded by a pair of heated rollers, where one roller had raised Pattern 3 (FIG. 8). The temperature of the calender rollers (smooth roller/patterned roller) was 160° C./162° C. and the bonding pressure was 75 N/mm. The resulting nonwoven web had material properties as shown in Table 4.

Example 7

The same nonwoven web was formed as described in Comparative Example 7, but with an additional step of hydro-patterning. The hydro-patterning was achieved with two drums, with the last drum in the line providing the web with apertures. The first drum had a wire mesh screen and one injector at the drum applying a water pressure of 150 bar to hydrotreat the web before aperturing at the second drum. The one injector at the first drum had two rows of holes, with the holes within each strip spaced a distance of 1.2 mm from one another. The second drum had a screen with an Q5 pattern of pins (hearts) as described herein. Three injectors applying water pressure of 220 bar, 220 bar and 250 bar, respectively, were used to hydro-pattern the web with a pattern of apertures by forcing the web down onto the pins. The three injectors at the second drum each had two strips of holes, with the holes within each strip spaced a distance of 0.6 mm from one another. The aperturing process of Example 7 is summarized in Table 5. The resulting nonwoven web had material properties as shown in Table 4.

Comparative Example 8 (Precursor Web to Example 8)

A 25 gsm spunmelt type nonwoven batt was produced online in a continuous process from a mixture of polypropylene (Mosten NB425 from Unipetrol) with color additive (SCC 91056 from Standridge Color Corporation), where monocomponent polypropylene filaments with a fiber diameter of 13-25 μm were produced and subsequently collected on a moving belt. The batt was produced on REICOFIL 4 technology from three spunbond beams. The nonwoven batt was fully bonded by a pair of heated rollers, where one roller had raised Pattern 1 (FIG. 6). The temperature of the calender rollers (smooth roller/patterned roller) was 160° C./162° C. and the bonding pressure was 75 N/mm. The resulting nonwoven web had material properties as shown in Table 4.

Example 8

The same nonwoven web was formed as described in Comparative Example 8, but with an additional step of hydro-patterning. The hydro-patterning was achieved with two drums, with the last drum in the line providing the web with apertures. The first drum had a wire mesh screen and one injector at the drum applying a water pressure of 150 bar to hydrotreat the web before aperturing at the second drum. The one injector at the first drum had two rows of holes, with the holes within each strip spaced a distance of 1.2 mm from one another. The second drum had a screen with an Q5 pattern of pins (hearts) as described herein. Three injectors applying water pressure of 220 bar, 220 bar and 250 bar, respectively, were used to hydro-pattern the web with a pattern of apertures by forcing the web down onto the pins. The three injectors at the second drum each had two strips of holes, with the holes within each strip spaced a distance of 0.6 mm from one another. The aperturing process of Example 8 is summarized in Table 5. The resulting nonwoven web had material properties as shown in Table 4.

Comparative Example 9 (Precursor Web to Example 9)

A 25 gsm spunmelt type nonwoven batt was produced online in a continuous process from a mixture of polypropylene (Mosten NB425 from Unipetrol) with color additive (SCC 91056 from Standridge Color Corporation), where monocomponent polypropylene filaments with a fiber diameter of 13-25 μm were produced and subsequently collected on a moving belt. The batt was produced on REICOFIL 4 technology from three spunbond beams. The nonwoven batt was fully bonded by a pair of heated rollers, where one roller had raised Pattern 3 (FIG. 8). The temperature of the calender rollers (smooth roller/patterned roller) was 160° C./162° C. and the bonding pressure was 75 N/mm. The resulting nonwoven web had material properties as shown in Table 4.

Example 9

The same nonwoven web was formed as described in Comparative Example 9, but with an additional step of hydro-patterning. The hydro-patterning was achieved with two drums, with the last drum in the line providing the web with apertures. The first drum had a wire mesh screen and one injector at the drum applying a water pressure of 150 bar to hydrotreat the web before aperturing at the second drum. The one injector at the first drum had two rows of holes, with the holes within each strip spaced a distance of 1.2 mm from one another. The second drum had a screen with an Q5 pattern of pins (hearts) as described herein. Three injectors applying water pressure of 220 bar, 220 bar and 250 bar, respectively, were used to hydro-pattern the web with a pattern of apertures by forcing the web down onto the pins. The three injectors at the second drum each had two strips of holes, with the holes within each strip spaced a distance of 0.6 mm from one another. The aperturing process of Example 9 is summarized in Table 5. The resulting nonwoven web had material properties as shown in Table 4.

Comparative Example 10 (Precursor Web to Example 10)

A 30 gsm spunmelt type nonwoven batt was produced online in a continuous process from bicomponent filaments of core/sheath type with a ratio of 80:20. The core was formed of aliphatic polyester (PLA Ingeo 6100D from Nature Works) and the sheath was formed of aliphatic polyester with lower melting point and crystallinity (PLA ingeo 6752 s from Nature Works) with slip additive (Avient CR Bio 2144 from Avient). Bicomponent filaments with a fiber diameter of 15-30 μm were produced and subsequently collected on a moving belt. The batt was produced on REICOFIL 4 technology from one spunbond beam. The nonwoven batt was fully bonded by a pair of heated rollers, where one roller had raised Pattern 1 (FIG. 6). The temperature of the calender rollers (smooth roller/patterned roller) was 140° C./138° C. and the bonding pressure was 50 N/mm. The resulting nonwoven web had material properties as shown in Table 4.

Example 10

The same nonwoven web was formed as described in Comparative Example 10, but with an additional step of hydro-patterning. The hydro-patterning was achieved with two drums, with the last drum in the line providing the web with apertures. The first drum had a wire mesh screen and one injector at the drum applying a water pressure of 100 bar to hydrotreat the web before aperturing at the second drum. The one injector at the first drum had two rows of holes, with the holes within each strip spaced a distance of 1.2 mm from one another. The second drum had a screen with an Q5 pattern of pins (hearts) as described herein. Three injectors applying water pressure of 110 bar, 110 bar and 120 bar, respectively, were used to hydro-pattern the web with a pattern of apertures by forcing the web down onto the pins. The three injectors at the second drum each had two strips of holes, with the holes within each strip spaced a distance of 0.6 mm from one another. The aperturing process of Example 9 is summarized in Table 5. The resulting nonwoven web had material properties as shown in Table 4.

as described in Examples 1 through 6 is significantly higher than that of its corresponding Comparative Example. Higher COF is generally preferred by converters such as diaper manufacturers as it prevents diaper to diaper slippage, especially when the diapers are tightly packed to fit multiple diapers in a single pack. Although the tensile strength of each nonwoven as described in Examples 1 through 6 is lower than that of its corresponding Comparative Example, it is important to note that the hydro-patterned nonwoven webs described in Examples 1 through 6 each provide a hygiene product manufacturer with a unique fabric that meets typical product strength requirements and excellent abrasion resistance while providing a visually distinct (apertured) fabric and higher thickness. The visual clarity is a function of the fiber modulus, resulting from its composition and/or additives, combined with the bond pattern and pin geometry used to calender bond the precursor web. Hydro-apertured samples with the best visual clarity and abrasion performance were the result of fibers without softening additives and thermal bond patterns that overlayed with minimal conflict with the aperturing drum design to allow for the creation of apertures via the movement of the fibers. This is demonstrated by Example 3 which had the lowest abrasion performance, but good visual clarity while Example 5 had similar visual clarity but superior abrasion performance due to the difference in the calender bonding geometries.

TABLE 4

| | COMPARATIVE EXAMPLE (precursor web) | | | | EXAMPLE | | | |
|---|---|---|---|---|---|---|---|---|
| | 7 | 8 | 9 | 10 | 7 | 8 | 9 | 10 |
| MDT, N/cm | 11.5 | 7.7 | 9.1 | 19 | 10.7 | 5.89 | 8.57 | 6.21 |
| MDE, Peak, % | 42 | 37 | 45 | 10 | 66 | 46 | 58 | 14 |
| CDT, N/cm | 6.85 | 5.5 | 5.6 | 7.1 | 5.99 | 3.11 | 3.59 | 3.1 |
| CDE, Peak, % | 51 | 77 | 91 | 33 | 81 | 70 | 101 | 54 |
| MD HOM, g | 12.6 | 4.7 | 5.1 | 30 | 13 | 5.32 | 5.4 | 11.3 |
| CD HOM, g | 5 | 2.1 | 2 | 15.6 | 6.26 | 2.16 | 1.75 | 4.16 |
| Avg HOM, g | 8.8 | 3.4 | 3.55 | 22.8 | 9.63 | 3.74 | 3.575 | 7.73 |
| Thickness, mm | 0.39 | 0.22 | 0.21 | 0.37 | 0.75 | 0.57 | 0.51 | 0.63 |
| Kinetic CoF side A | 0.31 | 0.33 | 0.35 | 0.41 | 0.61 | 0.68 | 0.74 | 0.78 |
| Kinetic CoF side B | 0.3 | 0.32 | 0.33 | 0.41 | 0.65 | 0.64 | 0.66 | 0.75 |
| Abrasion data A side | 5 | 5 | 5 | 4.5 | 5 | 5 | 5 | 3.8 |
| Abrasion data B side | 5 | 5 | 5 | 4.7 | 5 | 5 | 5 | 4 |
| Visual Clarity | n/a | n/a | n/a | n/a | 4 | 4 | 4 | 5 |

TABLE 5

| | PATTERN of precursor web | LINE SPEED (mpm) | HYDRO-PATTERNING DRUM 1 STRIP | DRUM 1 INJ1 (bar) | DRUM 2 STRIP | DRUM 2 Pin pattern | DRUM 2 INJ1 (bar) | DRUM 2 INJ2 (bar) | DRUM 2 INJ3 (bar) | Energy flux (kWh/kg) |
|---|---|---|---|---|---|---|---|---|---|---|
| EXAMPLE 7 | 3 (S) | 100 | 2j12 | 200 | 1j6, 1j6, 2j6 | Q5 | 220 | 220 | 250 | 1.4 |
| EXAMPLE 8 | 1 (oval) | 100 | 2j12 | 200 | 1j6, 1j6, 2j6 | Q5 | 220 | 220 | 250 | 1.9 |
| EXAMPLE 9 | 3 (S) | 100 | 2j12 | 200 | 1j6, 1j6, 2j6 | Q5 | 220 | 220 | 250 | 1.9 |
| EXAMPLE 10 | 1 (oval) | 100 | 2j12 | 100 | 1j6, 1j6, 2j6 | Q5 | 110 | 110 | 120 | 0.6 |

As observed from Table 2, each nonwoven webs as described in Examples 1 through 6 is improved as compared to its corresponding Comparative Example in terms of thickness, with an average increase of at least 100%. It is also important to note that the COF of each nonwoven web It should be noted that tensile strength drop of the web during hydraulic treatments is not always the key parameter to evaluate. The tensile drop in the case of polyolefin based fabric typically needs to be as small as possible to fulfill requirements of convertors and final products. In contrast, Example 10 presents polyester-based fabric with rather high tensile strength. PLA based nonwovens typically have higher tensile strength, lower elongation and also higher HOM values. Hydraulic treatment of PLA based nonwovens according to the invention might cause a relatively higher drop in tensile strength (−67% in MD and −56% in CD) to values similar to polyolefin-based fabrics. But what is more important, softness indicators (especially HOM) also dropped to values much closer to polyolefin desired levels (AVG HOM from 22,8 to 7,8), and even the apertured fabric provided higher thickness comparing to the precursor (thicker fabric provides in general results in higher HOM values). Also, abrasion resistance remained high (close to 4 after hydraulic treatment) and visual clarity was perfect.

While in the foregoing specification a detailed description of specific embodiments of the invention was set forth, it will be understood that many of the details herein given may be varied considerably by those skilled in the art without departing from the spirit and scope of the invention.

Test Methods

The "tensile strength" and "elongation" of a nonwoven fabric was measured using testing methodology according to WSP 110.4.R4 (12) standard. Tensile strength can be expressed also as "MDT" for MD direction and "CDT" for CD direction. Accordingly, elongation can be also expressed as "MDE" for MD direction and "CDE" for CD direction.

The "Handle-O-Meter" or "HOM" stiffness test of nonwoven materials was performed in accordance with WSP test method 90.3 with a slight modification. The quality of "hand" is considered to be the combination of resistance due to the surface friction and flexural rigidity of a sheet material. The equipment used for this test method is available from Thwing Albert Instrument Co. In this test method, a 100×100 mm sample was used for the HOM measurement and the final readings obtained were reported "as is" in grams instead of doubling the readings per the WSP test method 90.3. Average HOM was obtained by taking the average of MD and CD HOM values. Typically, the lower the HOM values, the higher the softness and flexibility, while the higher HOM values means lower softness and flexibility of the nonwoven fabric.

"Thickness" or "measured height" or "caliper" of a nonwoven material was determined by means of a testing measurement methodology pursuant to European norm EN ISO 9073-2:1995 (corresponds to methodology WSP 120.6), which is modified in the following manner:

1. The material is to be measured by using a sample that is taken from production without being subjected to higher deformation forces or without being subjected to the effect of pressure for longer than a day (for example by the pressure exerted by the roller on the production equipment), whilst otherwise the material must be left for at least 24 hours laying freely on a surface.

2. The total pressure applied for the thickness measurement is 14.7 g/cm2.

3. When the fabric provides differences in thickness between edges of the apertures and the nonwoven itself, the value of the nonwoven between apertures shall be taken as the measured value.

"Kinetic coefficient of friction" or "kinetic CoF" of a nonwoven material was determined by using testing Machines Inc. 32-07 Series Friction Tester by means of the ASTM D 1894 standard. The reported data represents the nonwoven-to-nonwoven Kinetic Coefficient of Friction (CoF) on a 10 cm by 10 cm nonwoven sample placed under a 200 g sled which is pulled across a 25 cm×10 cm clamped sample of the same nonwoven, maintaining sidedness and orientation consistency (side A to side A; MD direction to MD direction), at a speed of 150 mm/min.

Figure 16:
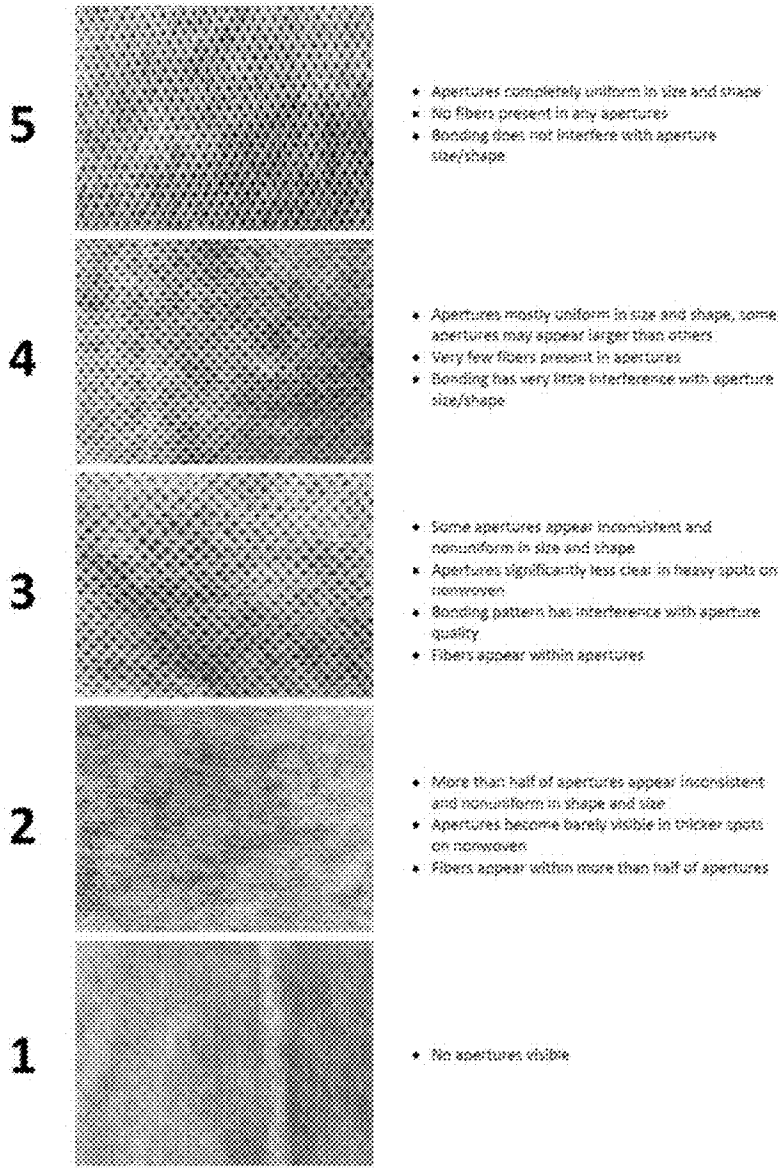
FIG. 16 is an Aperture Clarity Visual Ranking Scale according to an exemplary embodiment of the present invention.

"Visual clarity" was determined visually by the naked eye by at least five people independently according to an Aperture Clarity Visual Ranking Scale (see FIG. 16). At least three people from the five (or alternatively at least ⅗ of the evaluation group) need to have the same evaluation on each fabric in order for the evaluation to be recorded. The individual valuations that are not consistent with the other at least three evaluations are not counted.

"Martindale Average Abrasion Resistance Grade Test" or "Martindale"

Figure 17:
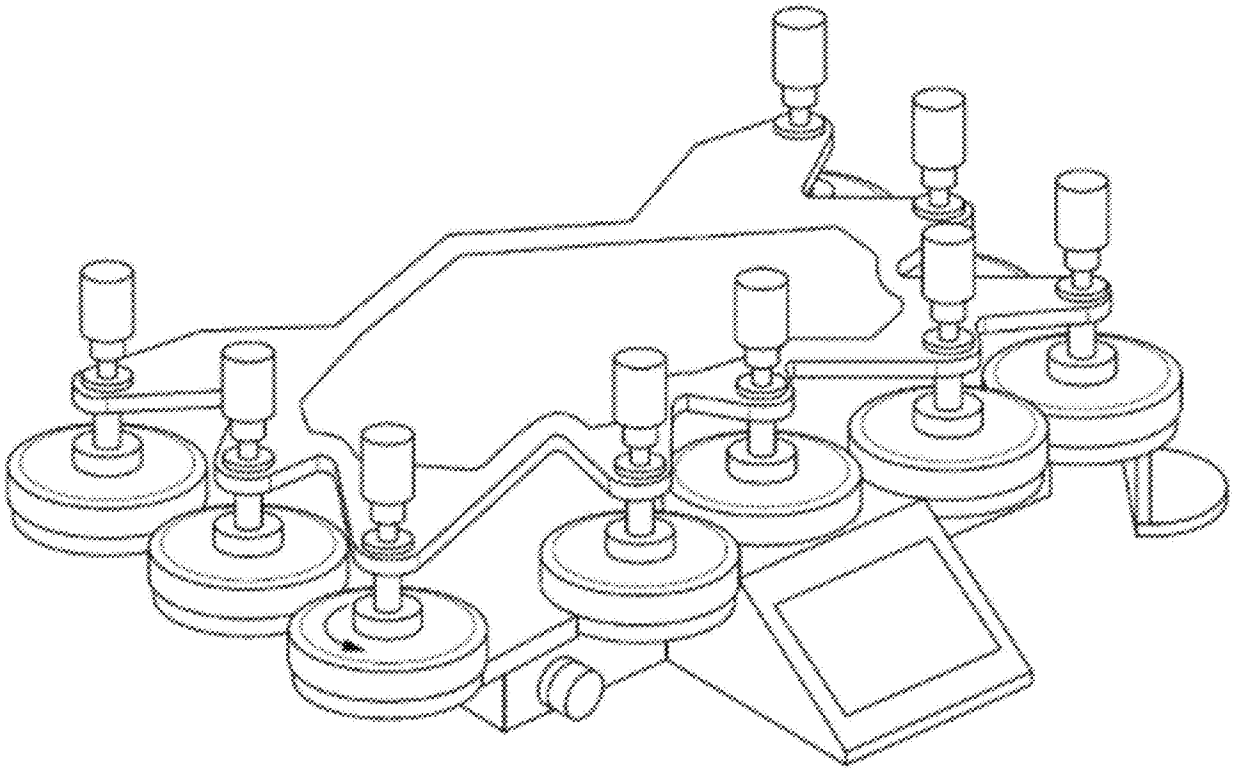
FIG. 17 is a perspective view of a grade scale for fuzz assessment in the Martindale Average Abrasion Resistance Grade Test.
Figure 18:
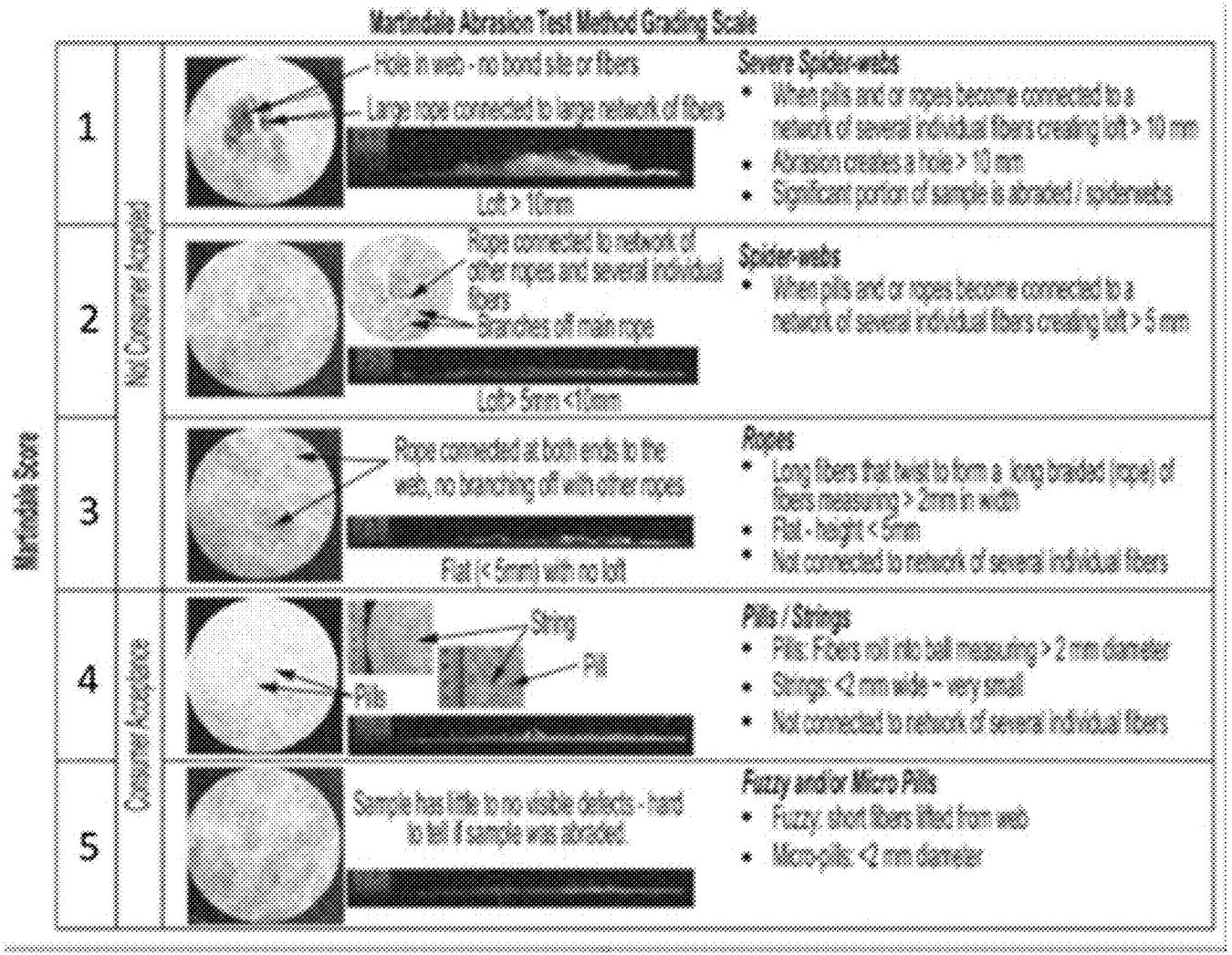
FIG. 18 is a Martindale Abrasion Test Method Grading Scale.

FIG. 17 is a perspective view of equipment for the Martindale Average Abrasion Resistance Grade Test. Specifically, FIG. 17 shows a grade scale for fuzz assessment in the Martindale Average Abrasion Resistance Grade Test.

Martindale Average Abrasion Resistance Grade of a nonwoven is measured using a Martindale Abrasion Tester. The test is conducted dry.

Nonwoven samples are conditioned for 24 hours at 23±2° C. and at 50±2% relative humidity.

From each nonwoven sample, cut 10 circular samples 162 mm (6.375 inches) in diameter. Cut a piece of Standard Felt into a circle of 140 mm in diameter.

Secure each sample on each testing abrading table position of the Martindale by first placing the cut felt, then the cut nonwoven sample. Then secure the clamping ring, so no wrinkles are visible on the nonwoven sample.

Assemble the abradant holder. The abradant is a 38 mm diameter FDA compliant silicone rubber 1/32 inch thick (obtained from McMaster Carr, Item 86045K21-50A). Place the required weight in the abradant holder to apply 9 kPa pressure to the sample. Place the assembled abradant holder in the Model #864 such that the abradant contacts the NW sample as directed in the Operator's Guide.

Operate the Martindale abrasion under conditions below:

Mode: Abrasion Test

Speed: 47.5 cycles per minute; and

Cycles: 80 cycles

After the test stops, place the abraded nonwoven on a smooth, matte, black surface and grade its fuzz level using the scale provided in FIG. 17. Each sample is evaluated by observing both from the top, to determine dimension and number of defects, and from the side, to determine the height of the loft of the defects. A number from 5 to 1 is assigned based on the best match with the grading scale. The Martindale Average Abrasion Resistance Grade is then calculated as the average rating of all samples and reported to nearest tenth.

"Bond Area Percentage" is determined using ImageJ software (Vs. 1.43u, National Institutes of Health, USA) by identifying a single repeat pattern of bond impressions and unbonded areas and enlarging the image such that the repeat pattern fills the field of view. In ImageJ draw a box that encompasses the repeat pattern. Calculate area of the box and record to the nearest 0.01 $mm^2$. Next, with the area tool, trace the individual bond impressions or portions thereof entirely within the box and calculate the areas of all bond impressions or portions thereof that are within the box. Record to the nearest 0.01 $mm^2$. Calculate as follows:

$$\text{Percent Bond Area} = (\text{Sum of areas of bond impressions within box})/(\text{area of box}) \times 100\%$$

Repeat for a total of five non-adjacent ROI's randomly selected across the total specimen. Record as Percent Bond Area to the nearest 0.01%. Measurements are made on both specimens from each article. A total of three identical articles are measured for each sample set. Calculate the average and standard deviation of all 30 of the percent bond area measurements and report to the nearest 0.001 units.

The invention claimed is:

1. A method of forming an apertured hydro-patterned nonwoven web, comprising:

forming a nonwoven batt comprising continuous spunmelt fibers;

calender bonding the nonwoven batt to form a fully bonded precursor nonwoven web with a regular bond pattern that defines individual bond impressions and unbonded areas between the individual bond impressions, the regular bond pattern having a percentage bond area of 10% to 25%; and hydraulically imparting the fully bonded precursor nonwoven web with a plurality of apertures, the step of hydraulically imparting comprising hydraulically treating the fully bonded precursor nonwoven web by a plurality of steps of water injection as the fully bonded nonwoven web passes over a plurality of pins.

2. The method of claim 1, wherein each of the pins have a base portion and a top portion, where the area of the base portion is larger than the area of the top portion.

3. The method of claim 1, wherein each pin is symmetrical with respect to a longitudinal axis of the pin.

4. The method of claim 1, wherein each pin has a base, and distances between centers of immediately adjacent pins are at least 100% of a diameter of the base.

5. The method of claim 1, wherein heights of the pins are at least 100% of a thickness of the apertured nonwoven web.

6. The method of claim 1, preferably at least 115% of a thickness of the apertured nonwoven web.

7. The method of claim 1, wherein heights of the pins are at least 200% of a thickness of the precursor web.

8. The method of claim 1, wherein the pins are arranged at a surface which moves at substantially the same speed as the calender bonded precursor nonwoven web.

9. The method of claim 1, wherein the pins vary in terms of size and/or shape and are arranged on a screen or belt, and the distance between centers of immediately adjacent pins are at least 100% of a diameter of the base of the largest of the pins.

10. The method of claim 1, wherein the step of forming the precursor web comprises the spunmelt fibers of the nonwoven batt consisting of spunbond filaments.

11. The method of claim 10, wherein the the step of forming the precursor web comprises the nonwoven batt comprising two or more layers.

12. The method of claim 11, wherein the the step of forming the precursor web comprises the spunmelt fibers in each of the two or more layers comprising spunbond filaments.

13. The method of claim 10, wherein the step of forming the precursor web comprises an average fiber thickness difference between the layers being less than 20%.

14. The method of claim 10, wherein the step of forming the precursor web comprises at least one layer of the two or more layers comprising spunbond filaments and at least one other layer of the two or more layers comprising meltblown fibers.

15. The method of claim 13, wherein the step of forming the precursor web comprises at least one layer comprising spunbond filaments forming at least one outer layer of the nonwoven batt.

16. The method of claim 13, wherein the step of forming the precursor web comprises the nonwoven batt comprising three or more layers, and the three or more layers form a spunbond-meltblown-spunbond (SMS) structure.

17. The method of claim 1, further comprising the step of applying at least one layer formed of fibers and/or particles to the fully bonded nonwoven precursor web before the step of hydraulically treating.

18. The method of claim 16, wherein the fibers are short synthetic fibers.

19. The method of claim 16, wherein the fibers are natural fibers.

20. The method of claim 1, wherein the step of forming the precursor web comprises the continuous spunmelt fibers being mono-component fibers formed of thermoplastic polymer, preferably polyolefin or polyester or polyamide based homopolymer, copolymer, or polymer blend.

21. The method of claim 1, wherein the step of forming the precursor web comprises the continuous spunmelt fibers being multicomponent, preferably bicomponent, fibers and wherein each component is formed of thermoplastic polymer, preferably polyolefin or polyester or polyamide based homopolymer, copolymer, or polymer blend.

22. The method of claim 20, wherein a component polymer composition present on at least 40% of each filament surface has a melting temperature that is lower as compared to a melting temperature of at least one other component polymer composition.

23. The method of claim 1, wherein the step of forming the precursor web comprises the continuous spunmelt fibers comprising polyolefin or polyamide or polyester or polysaccharide homopolymer, copolymer or polymer blend.

24. The method of claim 1, wherein the step of forming the precursor web comprises the continuous spunmelt fibers comprising polypropylene, polyethylene, polylactic acid, polyhydroxyalkanoates, polyhydroxybutyrate, polybutylene succinate, polyethylene terephthalate, thermoplastic starch, their copolymers, their copolymers with olefins, esters, amides or other polymers or blends thereof.

25. The method of claim 1, wherein the step of forming the precursor web comprises the continuous spunmelt fibers being bicomponent core-sheath fibers with a core comprising polypropylene and a sheath comprising a blend of polypropylene and copolymer polypropylene-polyethylene.

26. The method of claim 1, wherein step of forming the precursor web comprises the continuous spunmelt fibers comprising additives.

27. The method of claim 26, wherein the additives comprise additives of a type selected from the group consisting of: color pigments, softness enhancers, slip agents, fillers and combinations thereof.

28. The method of claim 1, wherein the step of forming the precursor web comprises forming of bond impressions having a bond shape.

29. The method of claim 28, wherein the bond impressions have a first size and the bond impressions are formed of bond points or dots that have a second size, wherein the second size is less than the first size.

30. The method of claim 28, wherein the bond shape is oriented such that a line intersecting the bond shape perimeter along which the greatest measurable length exists and intersects an axis lying on a surface along the machine direction to form an angle $\alpha T$ of 0 degree to 65 degrees.

31. The method of claim 28, wherein the bond shape comprises a convex portion.

32. The method of claim 28, wherein the bond shape comprises a concave portion.

33. The method of claim 28, wherein the bond shape comprises at least one of a convex portion and a concave portion.

34. The method of claim 28, wherein the bond shape is asymmetric.

35. The method of claim 28, wherein the bond impressions have a bond shape, and the bond shape is oval.

36. The method of claim 28, wherein the bond impressions have a bond shape, and the bond shape is line.

37. The method of claim 28, wherein the bond impressions have a bond shape with a bond shape perimeter having a greatest measurable length and a greatest measurable width.

38. The method of claim 37, wherein an aspect ratio of the greatest measurable length to the greatest measurable width is at least 1.0.

39. The method of claim 28, wherein the fully bonded nonwoven precursor web comprises at least 20 bonding impressions per square centimeter.

40. The method of claim 37, wherein a bonding impression line intersecting a bond shape perimeter along which the greatest measurable length exists and intersects an axis lying on the surface along the machine direction to form an angle $\alpha T$ of 20 degrees to 80 degrees.

41. The method of claim 28, wherein the step of forming the precursor web comprises forming of the fully bonded nonwoven precursor web with less than 20 bonding impressions per square centimeter.

42. The method of claim 41, wherein the bonding impressions have a bond shape with a bond shape perimeter having a greatest measurable length and a greatest measurable width, and an aspect ratio of the greatest measurable length to the greatest measurable width is at least 2.0.

43. The method of claim 41, wherein the bond shape is a line.

44. The method of claim 41, wherein the bond shape is S shape.

45. The method of claim 42, wherein the bonding impressions have a bond shape with a bond shape perimeter having a greatest measurable length and a greatest measurable width, and a bonding impression line intersecting the bond shape perimeter along which the greatest measurable length exists and intersects an axis lying on the surface along the machine direction to form an angle $\alpha T$ of 5 degree to 15 degrees.

46. The method of claim 1, wherein the step of forming the precursor web comprises forming bond impressions in a form of quilted pattern.

47. The method of claim 46, wherein the bonding impressions in a quilted pattern have a quilted pattern line that intersects an imaginary line extending in the machine direction to form an angle $\alpha Tq$ of 5 degree to 60 degrees.

48. The method of claim 1, wherein the precursor nonwoven web has an MD HOM value of at least 5 g.

49. The method of claim 1, wherein the precursor nonwoven web has a CD HOM value of at least 2 g.

50. The method of claim 1, wherein the precursor nonwoven web has an MD HOM value of 30 g or less.

51. The method of claim 1, wherein the precursor nonwoven web has a CD HOM value of 20 g or less.

52. The method of claim 1, wherein the precursor nonwoven web has a basis weight of at least 5 gsm.

53. The method of claim 1, wherein the precursor nonwoven web has a basis weight of 60 gsm or less.

54. The method of claim 1, wherein the step of hydraulically treating comprises applying hydraulic pressure to the nonwoven precursor web with water injectors.

55. The method of claim 54, wherein the hydraulic pressure applied to the precursor web is expressed as energy flux of at least 0.2 kWh/kg.

56. The method of claim 54, wherein the hydraulic pressure applied to the precursor web is expressed as energy flux of 3.0 kWh/kg or less.

57. The method of claim 54, wherein the step of hydraulically treating comprises applying hydraulic pressure to the nonwoven precursor web by at least two sets of water injectors.

58. The method of claim 54, wherein the method is performed at a line speed of at least 150 m/min.

59. The method of claim 57, wherein the line speed is 450 m/min or less.

60. The method of claim 54, wherein the step of hydraulically treating comprises applying hydraulic pressure to the nonwoven precursor web by three sets of water injectors with each set of water injectors applying a pressure of 150 bar or greater.

61. The method of claim 54, wherein the step of hydraulically treating comprises applying hydraulic pressure to the nonwoven precursor web by three sets of water injectors with each set of water injectors applying a pressure that is greater than a pressure applied by a set of water injectors preceding the set of water injectors in the machine direction.

62. The method of claim 61, wherein the three sets of water injectors comprise a first set of water injectors, a second set of water injectors preceding the first set of water injectors in the machine direction and a third set of water injectors preceding the first and second water injectors in the machine direction, the second set of water injectors apply a pressure of between 80% to 95% of the pressure applied by the first set of water injectors, and the third set of water injectors apply a pressure of between 64% to 90% of the pressure applied by the second set of water injectors.

63. The method of claim 54, wherein the step of hydraulically treating comprises applying hydraulic pressure to the nonwoven precursor web by three sets of water injectors with each water injector applying a pressure of 200 bar or greater.

64. The method of claim 54, wherein the step of hydraulically treating comprises applying hydraulic pressure to the nonwoven precursor web by two sets of water injectors with each water injector applying a pressure of 300 bar or greater.

65. The method of claim 54, wherein the step of hydraulically treating comprises water jets applied to the calender bonded precursor nonwoven web at an angle of 80 to 100° with respect to the calender bonded precursor nonwoven web.

66. The method of claim 1, wherein the step of hydraulically imparting the fully bonded precursor nonwoven web with a plurality of apertures comprises at least partially altering the individual bond impressions by application of water pressure.

67. The method of claim 66, wherein the step of at least partially altering results in at least 60% of fully bonded portions of the individual bond impressions remaining after the step of hydraulically imparting.

68. The method of claim 66, wherein the step of at least partially altering results in at least 70% of fully bonded portions of the individual bond impressions remaining after the step of hydraulically imparting.

69. The method of claim 66, wherein the step of at least partially altering results in at least 80% of fully bonded portions of the individual bond impressions remaining after the step of hydraulically imparting.

70. The method of claim 66, wherein the step of at least partially altering results in at least 90% of fully bonded portions of the individual bond impressions remaining after the step of hydraulically imparting.

71. The method of claim 66, wherein the step of at least partially altering results in separating the individual bond impressions into at least two portions.

72. The method of claim 66, wherein the step of at least partially altering results in fibers in areas around perimeters of the individual bond impressions randomly frayed in and out of a major plane of the fully bonded precursor nonwoven web so as to at least partially eliminate three-dimensionality of the individual bond impressions.

73. Apertured hydro-patterned nonwoven web produced according to claim 1.

74. Apertured hydro-patterned nonwoven web according to claim 73, wherein a basis weight of the web is 60 gsm or less.

75. Apertured hydro-patterned nonwoven web according to claim 73, wherein the web has an MD tensile strength of at least 4 N/cm.

76. Apertured hydro-patterned nonwoven web according to the claim 73, wherein the web has a CD tensile strength of at least 2 N/cm.

77. Apertured hydro-patterned nonwoven web according to claim 73, wherein the web has a caliper of at least 12 microns/gsm of fabric.

78. Apertured hydro-patterned nonwoven web according to claim 73, wherein the web does not exhibit two sidedness in terms of abrasion rating.

79. Apertured hydro-patterned nonwoven web according to claim 73, wherein the web does not exhibit two sidedness in terms of coefficient of friction.

80. Apertured hydro-patterned nonwoven web according to claim 73, wherein the web has a visual aperture clarity of at least 3 on a scale of 1 to 5.

81. A method of forming an apertured hydro-patterned nonwoven web, comprising:

providing a fully bonded precursor nonwoven web with a regular bond pattern that defines individual bond impressions and unbonded areas between the individual bond impressions, the regular bond pattern having a percentage bond area of 10% to 25%; and hydraulically treating the fully bonded precursor nonwoven web by a plurality of steps of water injection as the fully bonded nonwoven web passes over a plurality of pins so as to form a plurality of apertures in the fully bonded precursor nonwoven web.

* * * * *